US011286068B2

(12) United States Patent
Pattuzzi et al.

(10) Patent No.: US 11,286,068 B2
(45) Date of Patent: Mar. 29, 2022

(54) MACHINE FOR PACKAGING AND METHOD OF PACKAGING ARTICLES IN TUBULAR PACKS OF PLASTIC FILM

(71) Applicant: FABIO PERINI S.P.A., Lucca (IT)

(72) Inventors: Fabio Pattuzzi, Bologna (IT); Luca Antoniazzi, Bologna (IT); Moreno Cremonini, Savignano sul Panaro (IT); Daniele Bolognesi, Ozzano Dell'Emilia (IT)

(73) Assignee: Fabio Perini S.p.A., Lucca (IT)

( * ) Notice: Subject to any disclaimer, the term of this patent is extended or adjusted under 35 U.S.C. 154(b) by 73 days.

(21) Appl. No.: 16/649,513

(22) PCT Filed: Sep. 27, 2018

(86) PCT No.: PCT/IB2018/057505

§ 371 (c)(1),
(2) Date: Mar. 20, 2020

(87) PCT Pub. No.: WO2019/064226

PCT Pub. Date: Apr. 4, 2019

(65) Prior Publication Data

US 2020/0307841 A1 Oct. 1, 2020

(30) Foreign Application Priority Data

Sep. 28, 2017 (IT) ..... 102017000108825

(51) Int. Cl.
*B65B 9/073* (2012.01)
*B65B 59/00* (2006.01)
(Continued)

(52) U.S. Cl.
CPC ..... *B65B 9/073* (2013.01); *B65B 25/146* (2013.01); *B65B 35/40* (2013.01); *B65B 35/44* (2013.01);
(Continued)

(58) Field of Classification Search
CPC ..... B65B 9/073; B65B 25/146; B65B 35/40; B65B 35/44; B65B 35/50; B65B 35/52;
(Continued)

(56) References Cited

U.S. PATENT DOCUMENTS 2,926,774 A * 3/1960 Oppermann ..... B21D 51/2692 198/464.4
3,269,086 A * 8/1966 Cloots et al. ..... B65B 9/06 53/550
(Continued)

FOREIGN PATENT DOCUMENTS

DE 4127612 A1 * 2/1993 ..... B65G 57/308
EP 1771335 B1 9/2008
WO 2007088567 A1 8/2007

*Primary Examiner* — Stephen F. Gerrity
(74) *Attorney, Agent, or Firm* — Breiner & Breiner, L.L.C.

(57) ABSTRACT

The packaging machine includes a wrapping tunnel, adapted to form a tube of plastic film around a group of articles and a feed conveyor adapted to feed articles to be packaged toward the wrapping tunnel. An elevator is positioned between the feed conveyor and the wrapping tunnel, and is movable vertically from a lower position, to receive articles coming from the feed conveyor, to a higher height, to transfer articles to the wrapping tunnel. A pusher is arranged to push articles to be packaged from the elevator into the wrapping tunnel. An auxiliary conveyor is also provided between the feed conveyor and the elevator. An upender is
(Continued)

associated with the auxiliary conveyor, adapted to be arranged selectively in an active position, to co-act with the auxiliary conveyor to upend articles coming from the feed conveyor and transfer them toward the elevator, and in a deactivated position.

26 Claims, 23 Drawing Sheets

(51) Int. Cl.

| | |
|---|---|
| ***B65B 59/02*** | (2006.01) |
| ***B65B 25/14*** | (2006.01) |
| ***B65B 35/40*** | (2006.01) |
| ***B65B 35/52*** | (2006.01) |
| ***B65B 35/54*** | (2006.01) |
| ***B65B 57/10*** | (2006.01) |
| ***B65B 35/58*** | (2006.01) |
| ***B65B 35/44*** | (2006.01) |

(52) U.S. Cl.
CPC ..... *B65B 35/52* (2013.01); *B65B 35/54* (2013.01); *B65B 35/58* (2013.01); *B65B 57/10* (2013.01); *B65B 59/001* (2019.05); *B65B 59/005* (2013.01); *B65B 59/02* (2013.01); *B65B 2210/04* (2013.01)

(58) Field of Classification Search
CPC ..... B65B 35/54; B65B 35/58; B65B 57/10; B65B 59/001; B65B 59/005; B65B 59/02; B65B 2210/04
USPC ..... 53/446, 447, 450, 493, 495, 498, 499, 53/535, 540, 541, 544, 550
See application file for complete search history.

(56) References Cited

U.S. PATENT DOCUMENTS

| | | | | | |
|---|---|---|---|---|---|
| 3,352,435 | A * | 11/1967 | Reinecke | B65B 35/50 | 53/152 |
| 3,585,777 | A * | 6/1971 | Pesch | B65B 35/50 | 53/447 |
| 4,679,379 | A | 4/1987 | Cassoli | | |
| 4,672,796 | A * | 6/1987 | Ono et al. | B65B 35/30 | 53/499 |
| 4,680,919 | A * | 7/1987 | Hirama et al. | B65B 35/243 | 53/499 |
| 5,039,276 | A * | 8/1991 | Leuvering | B65B 35/52 | 53/541 |
| 5,447,012 | A * | 9/1995 | Kovacs et al. | B65B 9/073 | 53/450 |
| 6,931,823 | B2 * | 8/2005 | Forte et al. | B65B 9/026 | 53/541 |
| 2007/0125242 | A1 * | 6/2007 | Dall'Omo et al. | B65B 25/146 | 99/450.4 |
| 2008/0209866 | A1 * | 9/2008 | Dall'Omo et al. | B65B 25/143 | 53/550 |
| 2010/0014953 | A1 * | 1/2010 | Antoniazzi et al. | B65B 25/146 | 414/789.5 |
| 2014/0026524 | A1 * | 1/2014 | Rooyakkers | B65B 25/146 | 53/446 |
| 2015/0329230 | A1 | 11/2015 | Rasi | | |
| 2019/0241376 | A1 * | 8/2019 | Feng et al. | B65G 49/068 | |

* cited by examiner

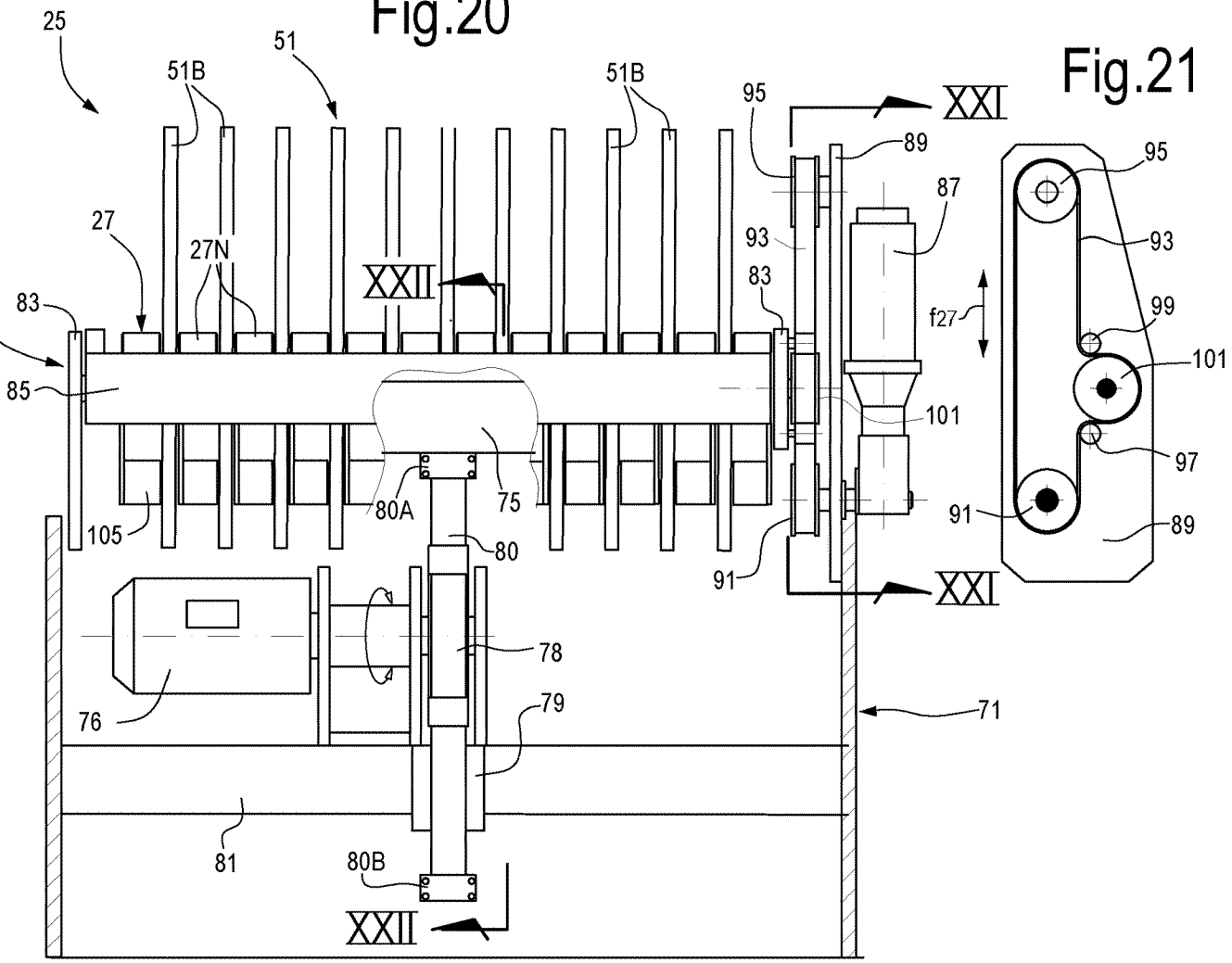
Fig.21
Fig.20
95
93
99
101
97
89
91
87
f27
XXI
XXII
71
83
51B
51
27N
27
25
73
85
105
75
80
78
79
80A
80B
76
81
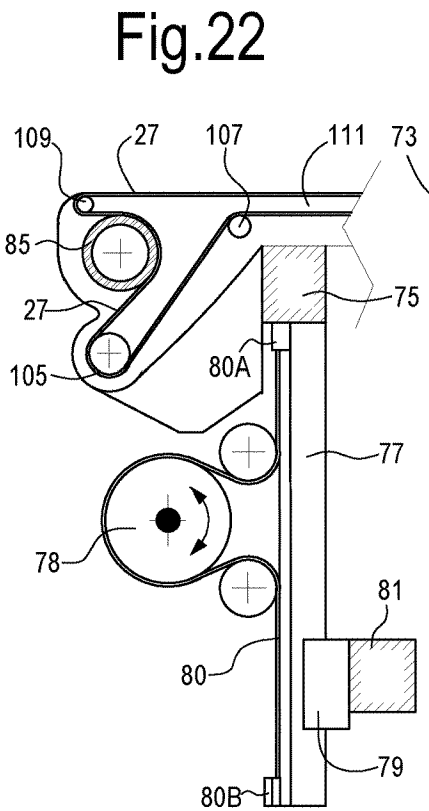
Fig.22
73
111
107
27
109
85
105
75
77
81
79
80A
80
80B
78

MACHINE FOR PACKAGING AND METHOD OF PACKAGING ARTICLES IN TUBULAR PACKS OF PLASTIC FILM

TECHNICAL FIELD

There are described herein packaging machines for producing packs of articles in bags or packs of plastic film. Embodiments described herein concern, in particular, packaging machines for packaging groups of articles in a pack formed by a welded plastic film, each of which consists of a pack of rolls of toilet tissue, kitchen towel or the like.

BACKGROUND ART

In the packaging sector of tissue paper, such as rolls of toilet tissue, rolls of kitchen towel, facial tissues and paper napkins, the production of packaged articles, each comprising a plurality of products ordered in groups, such as a plurality of rolls of tissue paper, is well known. These articles, intended for distribution to the final consumer, are in turn packaged in bags formed by a plastic film by means of a "wrapping tunnel", in which a web of plastic film is transformed into a tube of plastic film, which is subsequently filled with articles each formed by ordered groups of packs of rolls, and subsequently welded at the ends. The bags thus formed are intended for transportation to final distributors, such as department stores or the like. Here the bags can be opened and the single articles, each containing a plurality of rolls, are displayed on shelves for sale.

In other cases, the bags can contain single tissue paper products, packaged directly in the bags and not previously wrapped in a pack.

WO 2007/088567 describes a packaging machine of this type, with a wrapping tunnel and a group of members for feeding ordered groups of products to be packaged.

The single rolls of tissue paper can be arranged according to various geometries and in variable number inside each pack that forms the single article to be packaged in the tube of plastic film. As a function of the size, of the shape, of the orientation and of the arrangement of the articles to be grouped and packaged in the tube of plastic film, in other words, as a function of the format to be produced, different feed systems must be used.

Current machines have limits in terms of flexibility and capacity for adaptation of the machine to the type of pack to be packaged and to the arrangement and number of articles for each pack.

Therefore, it would be advantageous to produce more flexible machines, capable of being easily and automatically adapted to produce packs of variable size and shape.

SUMMARY OF THE INVENTION

According to one aspect, described herein is a packaging machine for packaging articles in packs of plastic film, comprising a wrapping tunnel, adapted to form a tube of plastic film around groups of articles. The machine further comprises a feed conveyor, adapted to feed articles to be packaged toward the wrapping tunnel. An elevator is positioned between the feed conveyor and the wrapping tunnel, which can advantageously be movable vertically from a lower position, to receive articles from the feed conveyor, to a higher position, to transfer articles to the wrapping tunnel. The machine also comprises a pusher to push articles to be packaged from the elevator into the wrapping tunnel. The movement of the pusher is controlled as a function of the size of the group of articles to be packaged.

As will be apparent from the detailed description below of embodiments of the machine and of the method forming the subject-matter of the present disclosure, by controlling the pusher as a function of the size of the group of articles to be packaged it is possible to obtain a faster operating cycle and consequently increase the productivity of the machine.

The size according to which the movement of the pusher is controlled can in practice be the size of the articles or groups of articles to be packaged, in the direction of advance of the articles toward the wrapping tunnel.

In some embodiments the machine can comprise a detection system of the size, in the direction of feed, of the group of articles to be transferred into the wrapping tunnel. The detection system can be associated with the elevator and can be positioned at a suitable height along the vertical stroke carried out by the elevator. The detection system can comprise, by way of non-limiting example, a series or array of pairs of optical emitters and receivers, arranged on opposite sides of the feed path of the articles to be packaged. It would also be possible to use other detection systems, for example of capacitive type, or viewing systems with video cameras, suitable to detect images that are then processed by an image processing software to obtain from the image information on the size of articles to be packaged. In other embodiments, a graduated scale can be provided that is filmed by a video camera together with the image of the articles aligned and prepared for insertion into the wrapping tunnel. The relative position of graduated scale, video camera and articles to be packaged is such that the size of the group of articles can be read on the image (via processing software) using the graduated scale.

Regardless of how the size of the articles to be packaged is detected, the movement of the pusher can be controlled as a function of the size detected by the detection system. In this way, the need to provide the control unit with data for calculating the size is avoided, and at the same time precise operation that also takes account of any differences between theoretical size and actual size of the articles to be packaged is obtained.

In other embodiments, the size is calculated by a central control unit as a function of the type of articles to be packaged. In particular, the user can supply the central control unit with data relating to the size of each article and to the number of articles aligned in the direction of advance, which must be inserted into each pack.

In possible embodiments the feed conveyor comprises: a main conveyor belt, with an inlet end and an outlet end for the articles to be packaged; a transfer belt, positioned between the outlet end of the main conveyor belt and the auxiliary conveyor; and a continuous flexible member, carrying a plurality of transverse bars, movable along a closed path, with an active portion and a return portion, the active portion extending along the feed path of the main conveyor belt and along the feed path of the transfer belt.

In some embodiments, a control unit of the packaging machine can be configured to define the loading height of the elevator, of the feed conveyor and of the auxiliary conveyor as a function of the height of the group of articles, so as to optimize the movement of each component and hence reduce the cycle time and increase the productivity of the packaging machine.

According to a further aspect, disclosed herein is a new method for packaging articles in tubular packs of plastic film, comprising the steps of: feeding a plurality of articles to be packaged along a feed path toward an elevator;

forming on the elevator an ordered group of articles to be packaged; lifting by means of the elevator the ordered group of articles to be packaged, from a lower position, at which the articles to be packaged are fed from the feed path onto the elevator, to a higher position, at which the articles are transferred from the elevator to a wrapping tunnel; pushing, by means of a pusher, the ordered group of articles from the elevator into the wrapping tunnel. Advantageously, the method can also provide for the step of controlling the movement of the pusher as a function of the size of the group of articles to be packaged in the direction of pushing into the wrapping tunnel.

Further advantageous features and embodiments of the packaging machine and of the method disclosed herein are set forth in the dependent claims and their many advantages will be apparent from the detailed description of some embodiments set forth below.

BRIEF DESCRIPTION OF THE DRAWINGS

The invention will be better understood by following the description and accompanying drawings, which show a non-limiting example of embodiment of the invention. More specifically, in the drawing:

FIG. 20 shows a view according to the line XX-XX of FIG. 19;

FIGS. 21 and 22 show local sections according to the lines XXI-XXI and XXII-XXII of FIG. 20, respectively;

DETAILED DESCRIPTION

The following detailed description of embodiments given by way of example refers to the accompanying drawings. The same reference numbers in different drawings identify identical or similar elements. Moreover, the drawings are not necessarily to scale. The following detailed description does not limit the invention. Rather, the scope of the invention is defined by the accompanying claims.

Reference in the description to "an embodiment" or "the embodiment" or "some embodiments" means that a particular feature, structure or element described in relation to an embodiment is included in at least one embodiment of the object described. Therefore, the phrase "in an embodiment" or "in the embodiment" or "in some embodiments" used in the description does not necessarily refer to the same embodiment or embodiments. Furthermore, the particular features, structures or elements may be combined in any appropriate manner in one or more embodiments.

Figure 1:
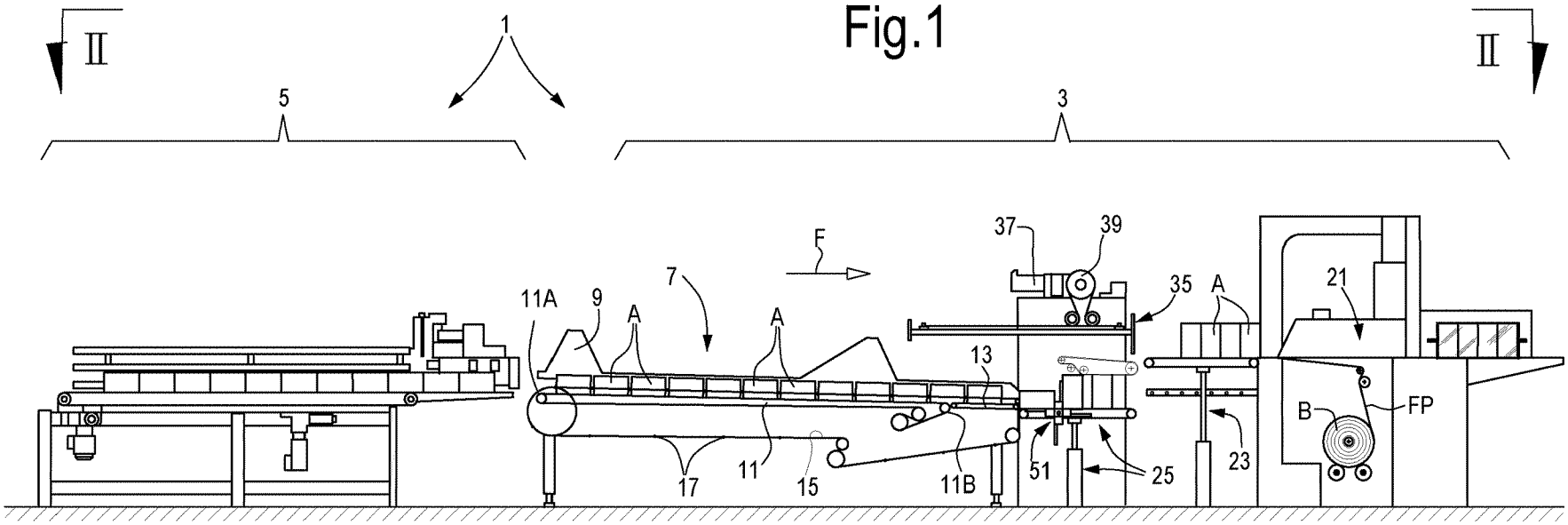
FIG. 1 shows a side view, according to I-I of FIG. 2, of a portion of packaging line in which a machine according to the present disclosure is arranged, in one embodiment.
Figure 2:
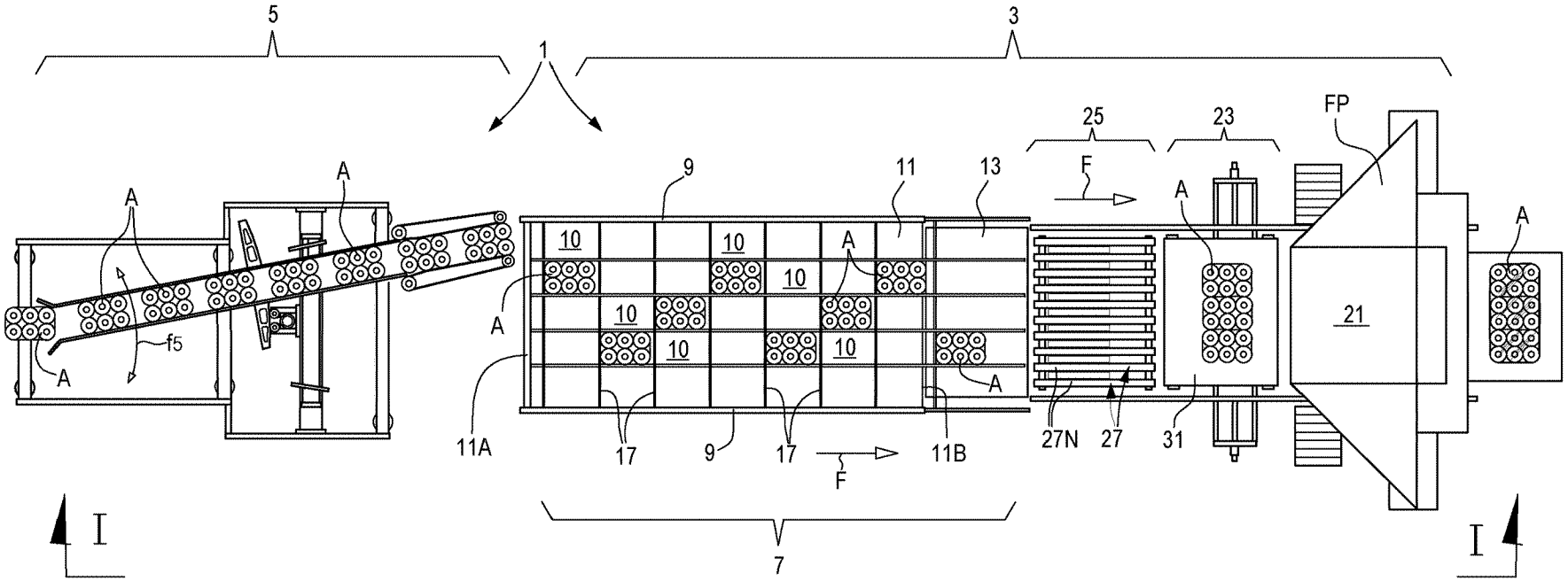
FIG. 2 shows a plan view according to II-II of FIG. 1.

FIGS. 1 and 2 show a portion of a packaging line 1, in which a packaging machine 3 according to the present disclosure is arranged. The portion of packaging line 1 illustrated in FIGS. 1 and 2 comprises a distributor (also called diverter) 5 that distributes single articles A, coming from a production line (not shown), on a feed conveyor indicated as a whole with 7. The feed conveyor 7 can have lateral side walls 9 and, between the lateral side walls 9, a plurality of channels 10 along which articles A to be packaged are fed in sequence. In practice, the distributor 5 receives a single row of articles A and distributes them sequentially in the single channels or paths 10 defined between the lateral side walls 9 of the feed conveyor 7. The number of channels 10 and their width in transverse direction with respect to a direction of advance F can be adjusted as a function of the transverse size of the articles A and of the number of articles A to be packaged in each single pack produced by the machine 3, as described below.

The distributor 5 is provided with a pivoting motion according to the double arrow f5 around a substantially vertical axis, in a known manner to distribute the articles A in the channels 10.

Each article A can consist of ordered groups or packs of products, typically rolls of tissue paper, as represented schematically in FIG. 2. The number or rolls for each article A illustrated in the accompanying figures is provided purely by way of example. This number, and the spatial distribution of the rolls in each article A can vary as a function of the production requirements on a case-by-case basis. Each article can also comprise a single roll.

The groups of rolls forming an article A can be packaged in a plastic film or can be loose.

Each article A can comprise one or more layers of rolls, each containing an arrangement of ordered rolls.

The group of rolls forming each article can be packaged in a welded plastic film, or also in a sheet of paper or the like. The articles A are formed in a station, not shown and known per se, of the production line upstream of the portion of production line 1 shown in FIGS. 1 and 2.

In the embodiment illustrated in the accompanying drawings, the feed conveyor 7 comprises a main conveyor belt 11, which can extend from an inlet end 11A to an outlet end 11B and along which the articles A to be packaged are fed. A transfer belt 13 can be arranged downstream of the main conveyor belt 11, with respect to the direction of feed F of the articles A.

Figure 3:
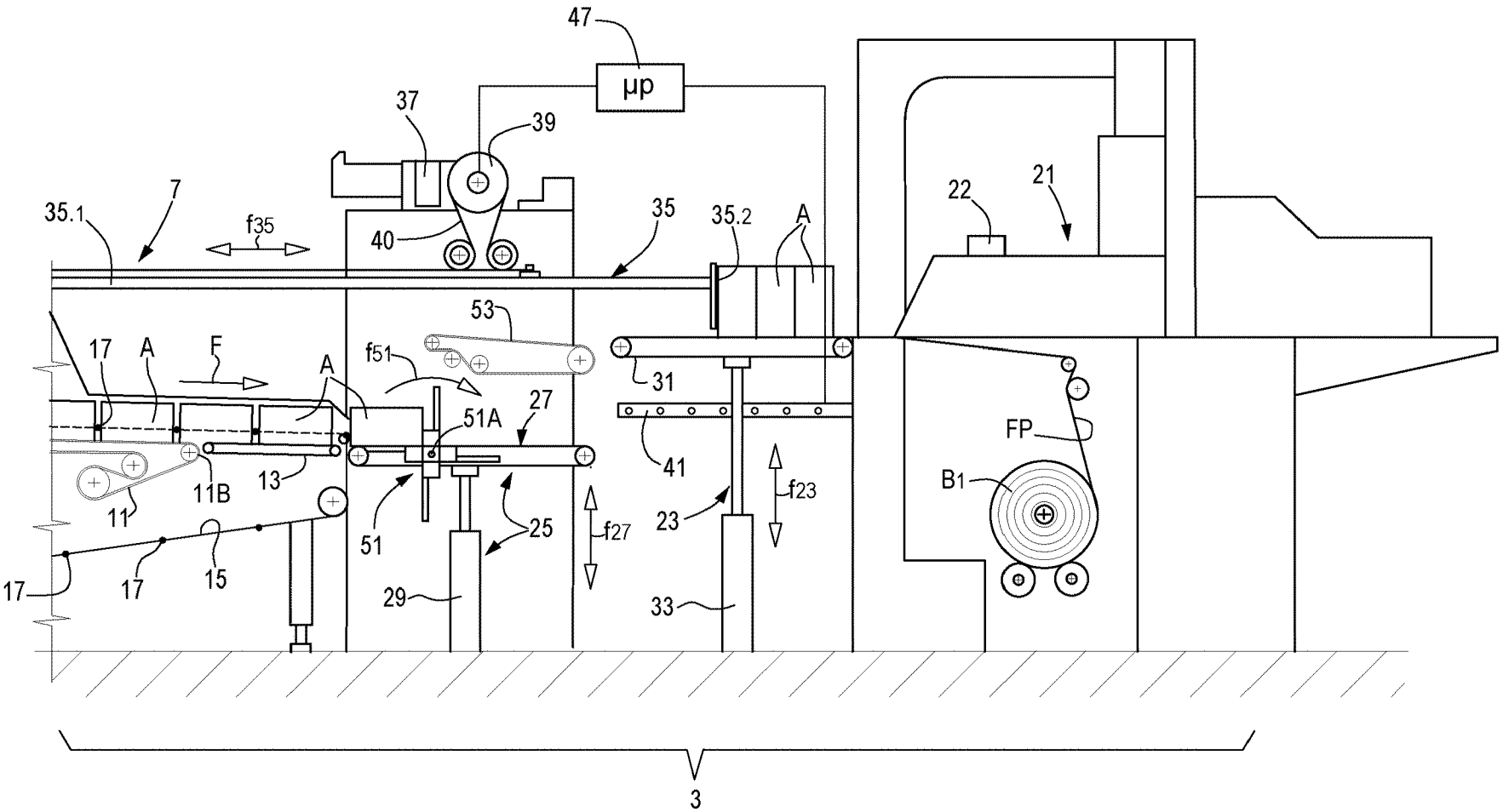
FIGS. 3, 4, 5, 6 show an operating sequence of the packaging machine of the present disclosure in a first operating mode.

The feed conveyor 7 can comprise, or can be associated with, a continuous flexible member 15 to which transverse bars 17 are fixed, visible in particular in FIG. 3 and following. The transverse bars 17 can act as pushing members or as stops for positioning the articles A that are fed according to the arrow F along the feed conveyor 7.

A wrapping tunnel 21, with a structure known per se, is arranged downstream of the feed conveyor 7. By means of the wrapping tunnel 21 a film of plastic material FP, unwound from a reel B 1, which can be placed under the wrapping tunnel 21, is transformed into a tube of plastic material that wraps the articles A to be packaged. The wrapping tunnel 21 can be associated with a welding member 22 that makes a longitudinal weld along the edges, folded one over the other, of the plastic film FP unwound from the reel B 1, to form the plastic tube, inside which the articles A to be packaged are inserted.

Positioned between the outlet of the feed conveyor 7 and the wrapping tunnel 21 are further members adapted to convey and group together the articles A in ordered groups, which are inserted in the tube of plastic film FP formed by the wrapping tunnel 21.

More in particular, an elevator 23 and a multi-function station, this latter positioned upstream of the elevator 23 with respect to the direction of advance F of the articles to be packaged, are placed between the feed conveyor 7 and the wrapping tunnel 21.

In some embodiments, the multi-function station 25 can comprise an auxiliary conveyor 27, for example a belt or preferably a plurality of belts or belt conveyors 27N (FIG. 2) parallel to and spaced from one another, which can advance the articles A in the direction of feed from the feed conveyor 7 toward the elevator 23. The belt(s) or belt conveyor(s) 27N defines or define a continuous flexible member that forms a surface for advancing the articles A toward the elevator 23.

The auxiliary conveyor 27 can be provided with a lifting and lowering movement according to double arrow f27. An actuator 29, such as a piston-cylinder actuator, or a mechanism with an electric motor and a threaded bar, or any other actuator that can be controlled electronically, can be used to move the auxiliary conveyor 27 according to double arrow f27, in order to adjust the height of the auxiliary conveyor 27.

The elevator 23 can comprise a further auxiliary conveyor 31, provided with a lifting and lowering movement according to the double arrow f23, controlled by an actuator 33, such as a piston-cylinder actuator, or a mechanism with an electronically controlled servo-motor or any other suitable means.

In general, the feed conveyor 7 is positioned, with its outlet end represented by the outlet of the transfer belt 13, at a height below the height of the wrapping tunnel 21. As will be clear from the description below, the multi-function station 25 can be utilized to group together the articles A, for example superimposing several articles on one another, i.e., it can act as a layering device, while the elevator 23 lifts the groups of articles A from the forming height of the groups of articles A coming from the feed conveyor 7 to the height of the wrapping tunnel 21.

A pusher 35, provided with a reciprocating rectilinear motion according to the double arrow f35, is provided to transfer the groups of articles A from the elevator 23 into the wrapping tunnel 21. This movement can be controlled by a servo-motor 37, for example an electric motor that operates a pulley 39 around which a belt 40 is guided, the ends of which are constrained to points of a rod 35.1 spaced from one another, said rod carrying at one end a pusher plate 35.2. The rod 35.1 and the pusher plate 35.2 form the main components of the pusher 35.

In some embodiments, a detection system 41 can be associated with the elevator 23, with the function of detecting the size, in the direction of feed (arrow F), of the groups of articles A to be inserted into each pack formed by the tube of plastic film FP produced by the wrapping tunnel 21. The purpose of the detection system 41 of the size of the group of articles A to be transferred into the wrapping tunnel 21 is to optimize the operating sequence of the various members of the machine 3 described above. In particular, the detection system 41 has the purpose of optimizing movement of the pusher 35, as will be explained below.

The machine 3 can also comprise a programmable control unit, indicated as a whole with 47, such as a microcontroller, a microcomputer, a PLC or an assembly of electronic hardware and software components. The control unit 47 can be interfaced to the servo-motor 37 and to the actuators 29 and 33, and if necessary to the moving components forming the feed conveyor 7, or more in particular, the main conveyor belt 11, the transfer belt 13 and the continuous flexible member 15 carrying the transverse bars 17. The control unit 47 can also be interfaced to the motor members that drive the auxiliary conveyors 27 and 31 of the multi-function station 25 and of the elevator 23. As will be described below, the multi-function station 25 can also be provided with further actuators or servo-motors to drive various components or devices included in the multi-function station 25. These further actuators or servo-motors can also be interfaced to the programmable control unit 47.

Figure 8:
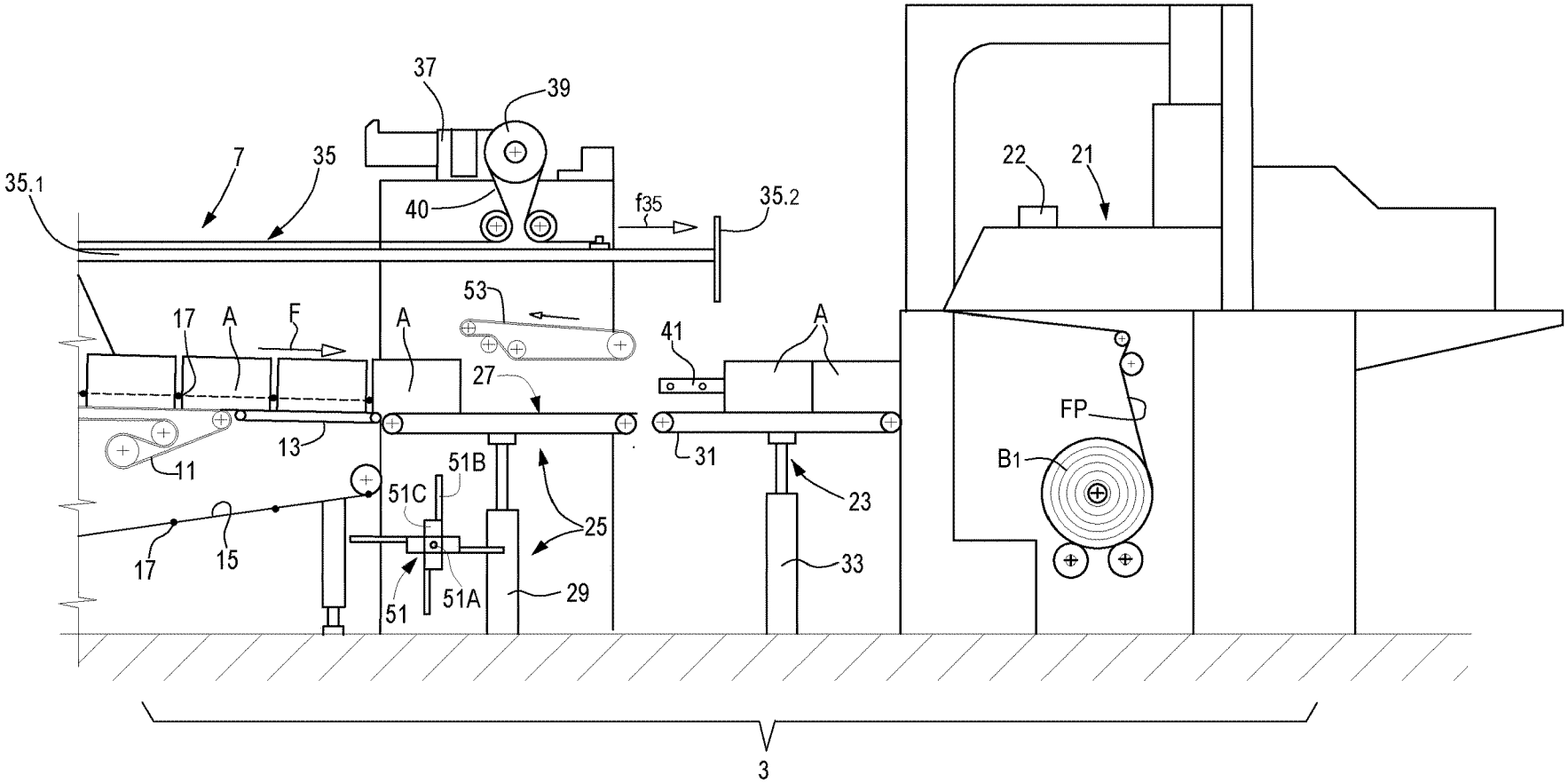
FIGS. 8, 9, 10 show an operating sequence of the packaging machine in a further operating mode.

FIGS. 3 to 6 illustrate the steps of a packaging sequence of articles A that require to be upended from a position hereinafter defined "horizontal" to a position hereinafter defined "vertical". An upender 51 arranged in the multi-function station 25 is provided for this purpose. Substantially, the upender 51 is a member configured to rotate according to the arrow f51 in steps of 90° around a horizontal axis 51A, transverse to the direction of advance F of the articles A to be packaged. As will be explained below, the upender 51 can be placed in an active position, as shown in FIGS. 3 to 6, or it can be withdrawn in an idle position, as shown in FIG. 8 and following, when the articles A to be packaged do not require to be upended from the horizontal position to the second vertical position.

The upender 51 can have a star configuration, with a central core or support 51C rotating around the horizontal axis 51A. Radial arms 51B with a star structure extend from the central core or support 51C. The radial arms 51B can, for example, be spaced from one another by 90°.

In some embodiments, the auxiliary conveyor 27 and the upender 51 are at least partially superimposed on one another in a plan view, to reduce the longitudinal overall dimension (i.e., the overall dimension in the direction of arrow F) of the multi-function station. For this purpose, according to some embodiments the auxiliary conveyor 27 can consist of a plurality of parallel and spaced belts. A free space is left between adjacent belts for passage of the arms 51B, which can each have a comb structure. Further details of an embodiment of this type will be described later.

In some embodiments, advantageously the position of the rotation axis of the core can be adjusted in vertical direction and/or in horizontal direction, to adapt the multi-function station 25 to different operating modes and/or to different sizes or shapes of the articles A to be handled. An embodiment of the upender will be described in more detail below.

FIGS. 3 to 6 show a further member that can be associated with the multi-function station 25. More in particular, this is a flexible member 53, which can comprise one or more belts or the like, which extend in a direction parallel to the direction of advance F of the articles A to be packaged and which is placed above the surface for advancing the articles A defined by the upper branch of the auxiliary conveyor 27 associated with, or part of, the multi-function station 25. As shown in FIGS. 3 to 6, between the upper branch of the auxiliary conveyor 27 and a portion of the lower branch of the flexible member 53 a space is defined, along which the articles A to be packaged are advanced in a controlled manner after having been upended by 90° (arrow f51) by the upender 51.

More in particular, FIG. 3 shows a moment of the packaging cycle in which the auxiliary conveyor 27 of the multi-function station 25 is aligned with the feed conveyor 7 and receives from this latter a first article A of a new group of articles A to be packaged in a tubular pack formed by the wrapping tunnel 21. The article A that is on the auxiliary conveyor 27 is still in horizontal position and will be upended in vertical position as a result of the 90° rotation of the upender 51.

Again, with reference to FIG. 3, a group of articles A to be packaged, upended in vertical position, is placed on the elevator 23. In this exemplary embodiment, the group of articles A comprises three adjacent articles, which must be inserted into a single tube of plastic film FP formed by the wrapping tunnel 21 to form a multiple pack of three articles A. However, it must be understood that the group of articles A to be packaged in each pack can differ from the one shown, for example a group of articles A can comprise only two articles, a single article or more than three articles.

From the configuration of FIG. 3, the group of articles A located on the elevator 23, which has been taken to the inlet height of the wrapping tunnel 21, is inserted into the wrapping tunnel 21 by means of the pusher 35 driven by the servo-motor 37.

While the group of articles A is transferred by means of the pusher 35 from the elevator 23 into the wrapping tunnel 21, a group of three articles A is formed on the auxiliary conveyor 27 by feeding single articles A from the feed conveyor 7, which are upended by 90° by the upender 51.

Figure 4:
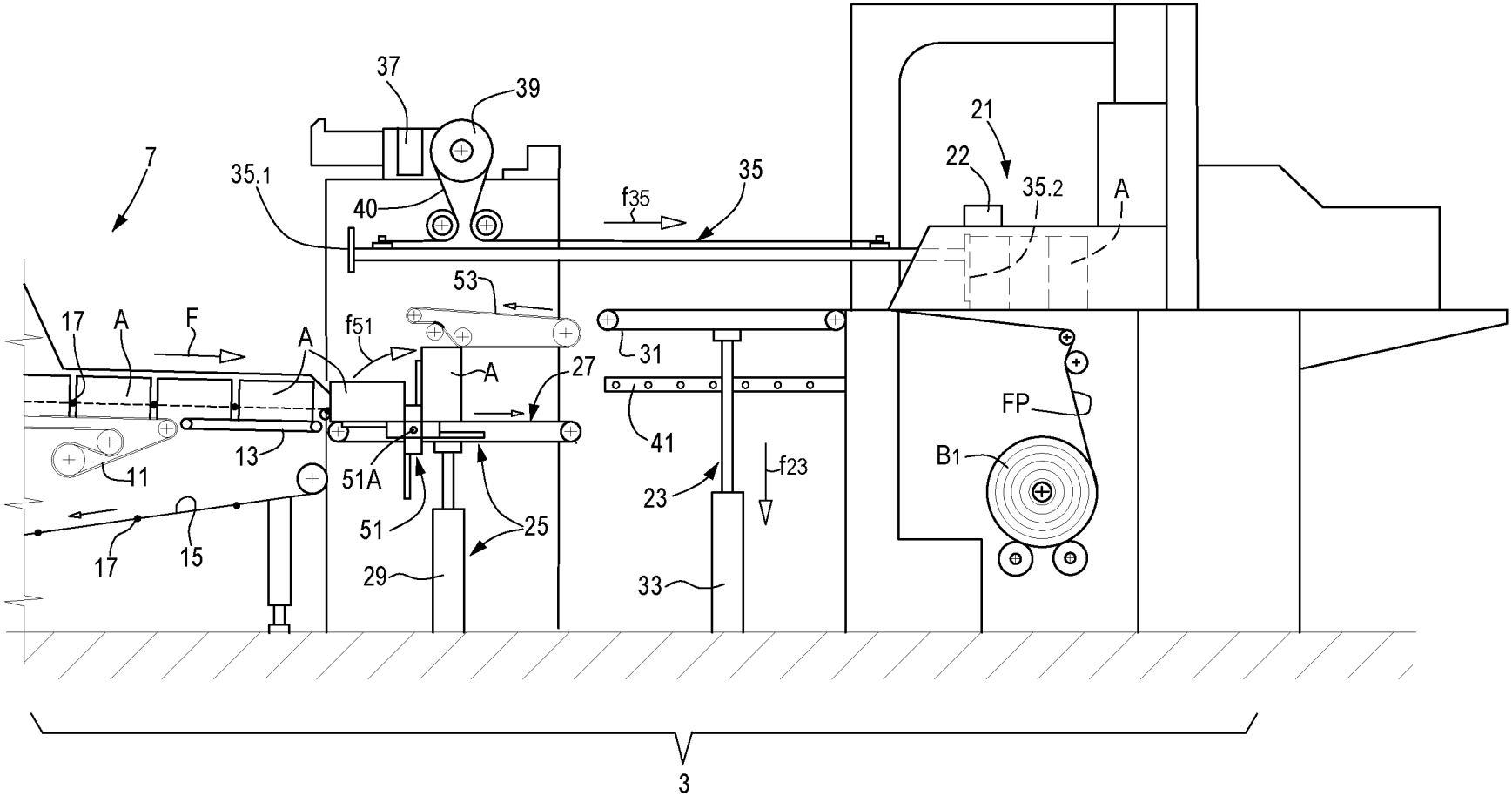

FIG. 4 shows a step in which the pusher 35 has inserted the group of articles A located on the elevator 23 into the wrapping tunnel 21, while a first article A that has been upended in vertical position and is entering the space between the auxiliary conveyor 27 and the flexible member 53 is located on the auxiliary conveyor 27. A second article A coming from the feed conveyor 7 is also located on the auxiliary conveyor 27. The second article A is in the inlet position of the auxiliary conveyor 27 and will subsequently also be upended by 90° by the upender 51.

In the configuration of FIG. 4 the elevator 23 has been cleared of the articles A previously placed thereon and can start its descent from the upper height aligned with the mouth of the wrapping tunnel 21 to the lower height aligned with the auxiliary conveyor 27 of the multi-function station 25.

Figure 5:
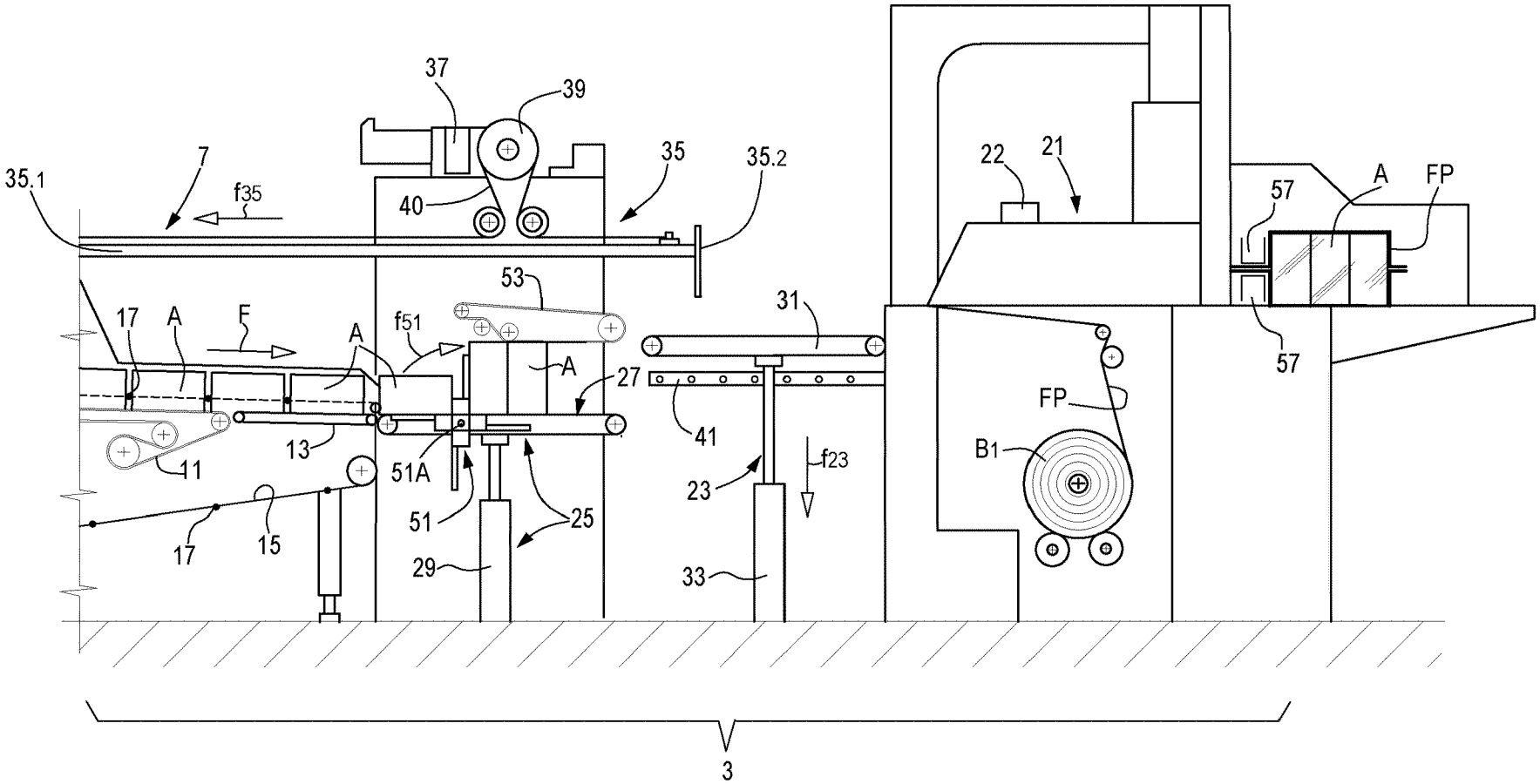

In the subsequent FIG. 5, the group of articles A previously inserted into the wrapping tunnel 21 has been completely wrapped by a length of tube of plastic film FP that is cut and welded by means of welding bars 57 represented schematically in FIG. 5 and not shown in the remaining figures.

The elevator 23 continues its descent or could already be positioned in its lower position aligned with the auxiliary conveyor 27. Two articles A upended in vertical position are located on this latter, one inserted into the space between the auxiliary conveyor 27 and the flexible member 53 and the other about to enter this space. A third article in horizontal position is about to be upended by the upender 51. The pusher 35 has been retracted to allow the subsequent lifting of a new group of articles A by the elevator 23.

Figure 6:
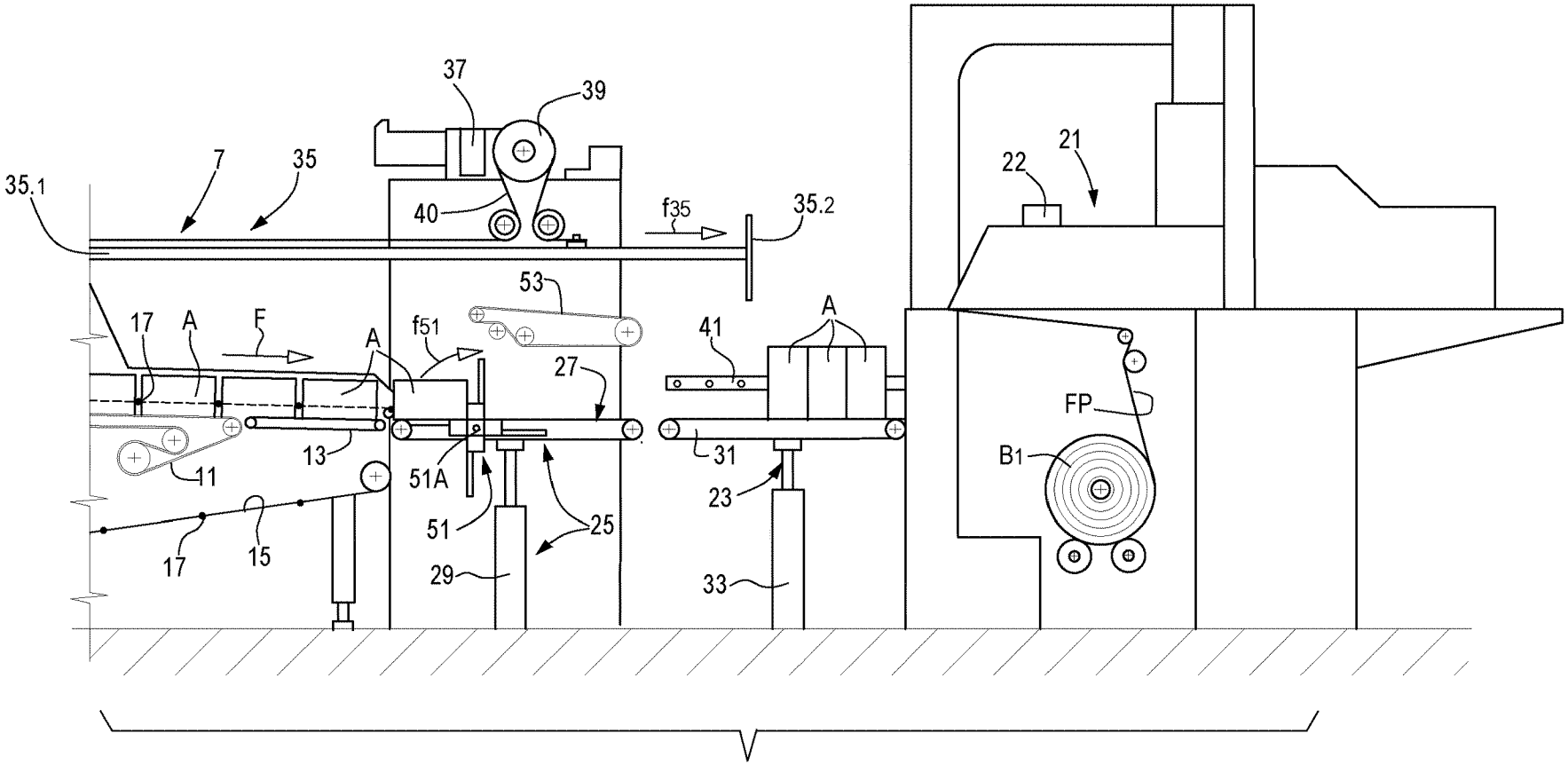

FIG. 6 shows the step in which three articles A upended in a vertical position have been transferred from the multi-function station 25 to the elevator 23. The conveyor belt 31 associated with the elevator 23 can continue to move the group of articles A located on the elevator 23 according to the arrow F toward the wrapping tunnel 21, so that the leading one of the articles A is located next to the edge of the elevator 23 closest to the wrapping tunnel 21, i.e., the edge downstream with respect to the direction of advance F of the articles A to be packaged.

The detection system of the size of the group of articles A to be packaged, indicated schematically with 41, is arranged so as to detect the size of the group of articles A in the direction of feed F, when the group of articles A is located in the most downstream position along the extension of the conveyor belt 31 of the elevator 23. Detection of this size is advantageous in order to optimize the movement of the pusher 35.

Alternatively, the size of the group of articles A can be calculated by the programmable control unit 47 as a function of the type of product to be packaged set by the operator or by a production management program. In this way the position of the pusher 35 is not adapted for each pack, but remains constant until the subsequent product change.

In fact, in order to reduce the cycle time, the pusher 35 can be advanced toward the wrapping tunnel 21 by an extent correlated to the longitudinal size (according to the arrow F) of the group of articles A ready to be lifted by the elevator 23 to the height of the wrapping tunnel 21, before the elevator 23 carries out its lifting movement or during the lifting movement. In this way the subsequent step of inserting the group of articles A into the wrapping tunnel 21 is shorter. In fact, the pusher 35 is already in an advanced position with respect to the position of maximum retraction, illustrated schematically in FIG. 5.

While in conventional machines the pusher 35 starts its stroke for insertion of the group of articles into the wrapping tunnel 21 only when the group of articles to be packaged has reached its upper height, defined by the upper limit of the lift stroke of the elevator 23, in the machine described herein the pusher can carry out a portion of the its stroke before the elevator 23 has reached its uppermost position. This is made possible in that the control unit 47 knows the size along to the direction F of the group of articles A and can therefore indicate to the servo-motor 37 to what point the pusher 35 can be advanced toward the wrapping tunnel 21 before the lift stroke of the elevator 23 has been completed, without the risk of the pusher 35 interfering with the articles A grouped together and ordered on the elevator 23 to be inserted into the wrapping tunnel 21.

Alternatively, the return stroke of the pusher 35 can be shortened without returning the pusher 35 to the position of maximum retraction. In this way the cycle times of the pusher 35 are optimized as the stroke during pushing of the group of articles A and the return stroke are shorter.

Figure 7:
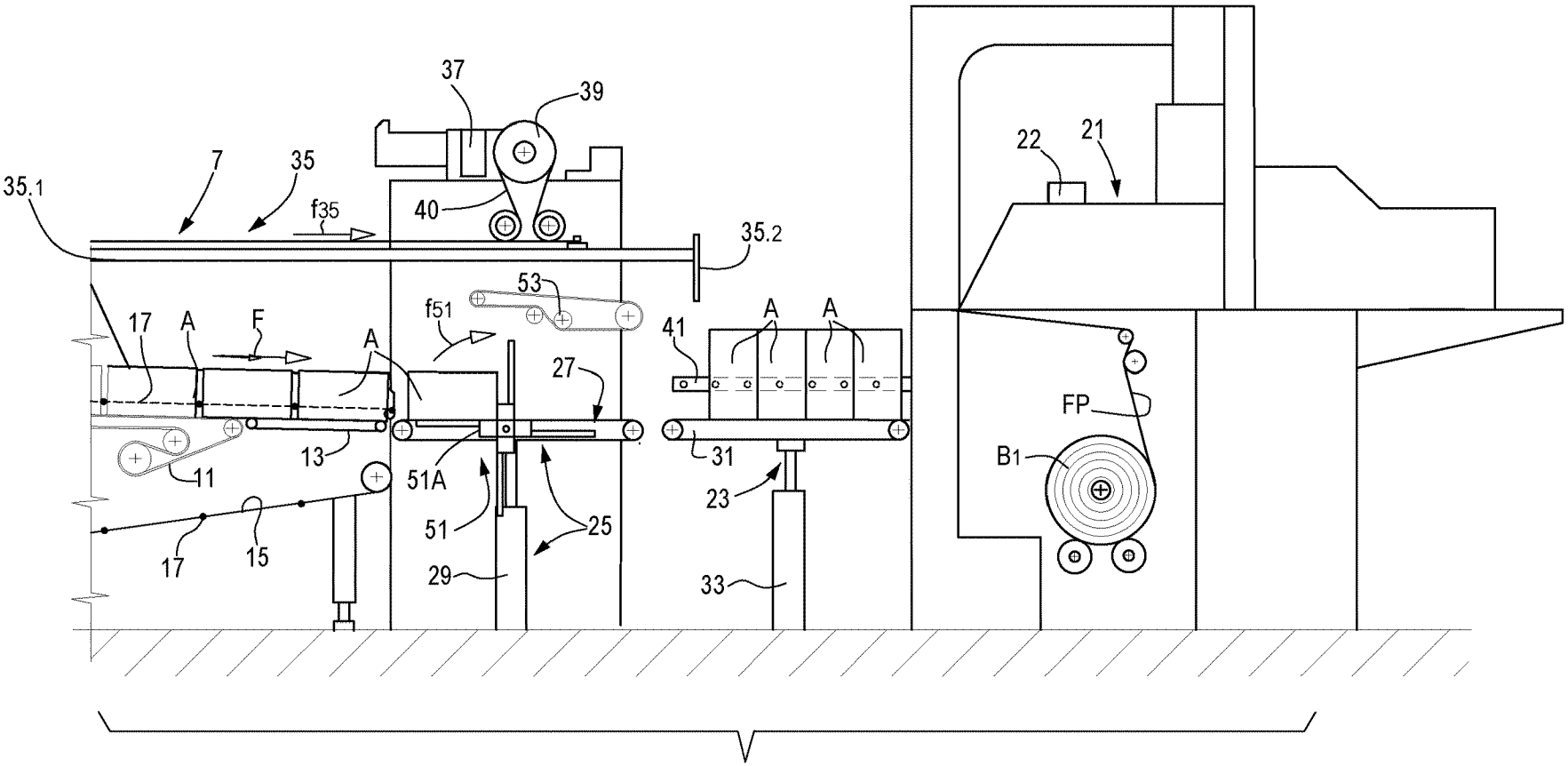
FIG. 7 shows an operating step of the packaging machine in another operating mode.

FIG. 7 illustrates an intermediate step of transfer of a group of articles A (in the present case, by way of example four articles A) of larger size than the size of the group of articles A of FIGS. 3 to 6. In this case, the forward stroke of the pusher 35 before the elevator 23 completes its lift stroke will be shorter than in the case of FIGS. 3 to 6, the stroke being determined also in this case by the size, along the direction F, of the group of articles A, detected by the detection system 41, or calculated previously by the programmable electronic control unit 47. As can be seen by comparing FIGS. 3 to 6 and FIG. 7, the machine has been adapted to the different vertical size of the articles A by adjusting the position of the upender 51, and more precisely the position of its rotation axis 51A, and the vertical position of the conveyor belt 53 above the auxiliary conveyor 27.

The detection system of the size in the direction F of the groups of articles A to be packaged can comprise any system adapted to detect the presence of articles A along the longitudinal extension of the elevator 23. For example, the detection system 41 can comprise optical emitters and receivers arranged according to linear arrays on the two sides of the path of the articles A moved horizontally according to the arrow F by the conveyor belt 31 of the elevator 23. In other embodiments other detection systems, such as ultrasonic, capacitive or the like, can be used.

The sequences described above and illustrated in FIGS. 3 to 7 are indicative and the various steps of each packaging cycle can differ from those shown in the drawing.

Figure 9:
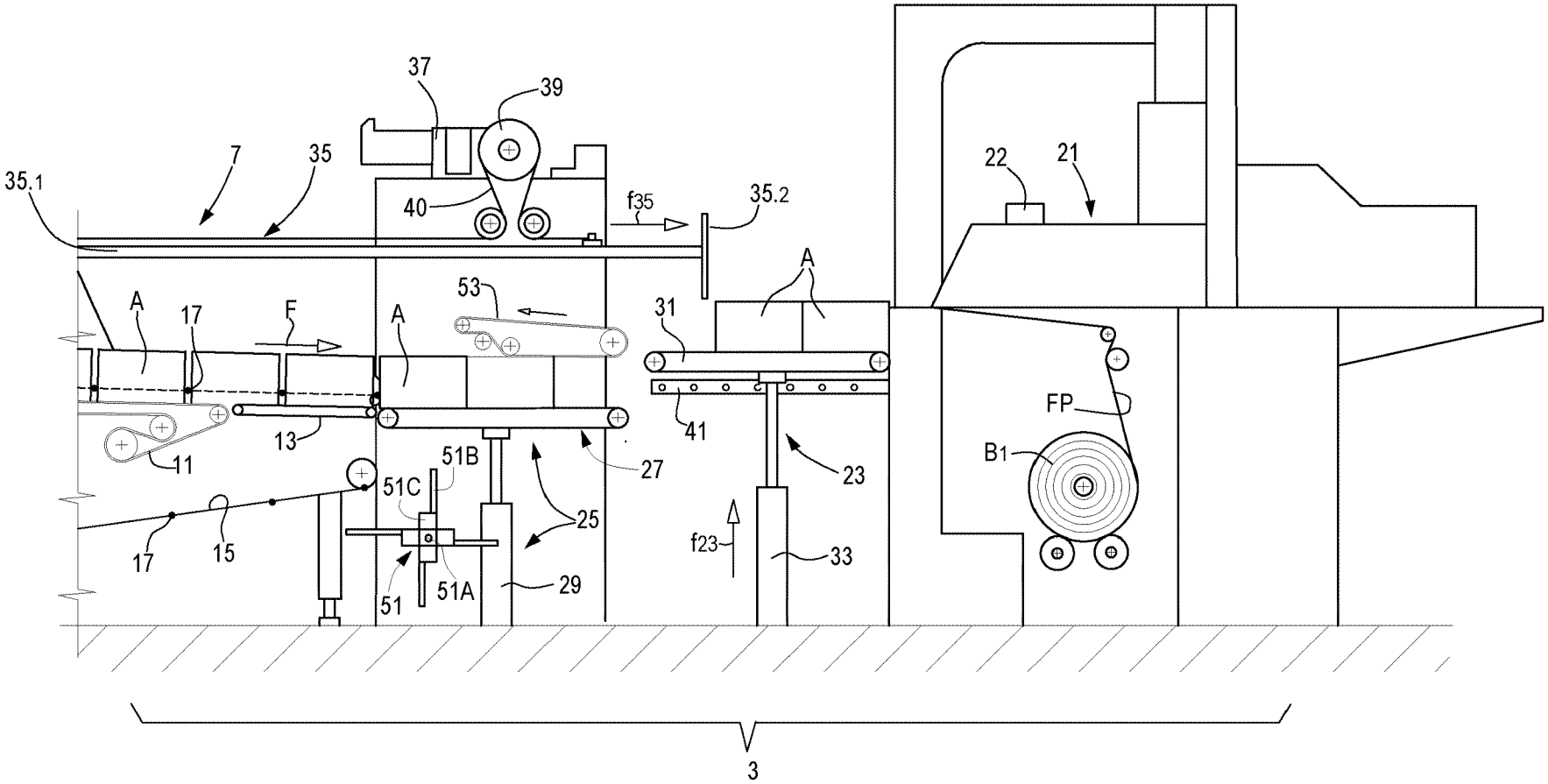
Figure 10:
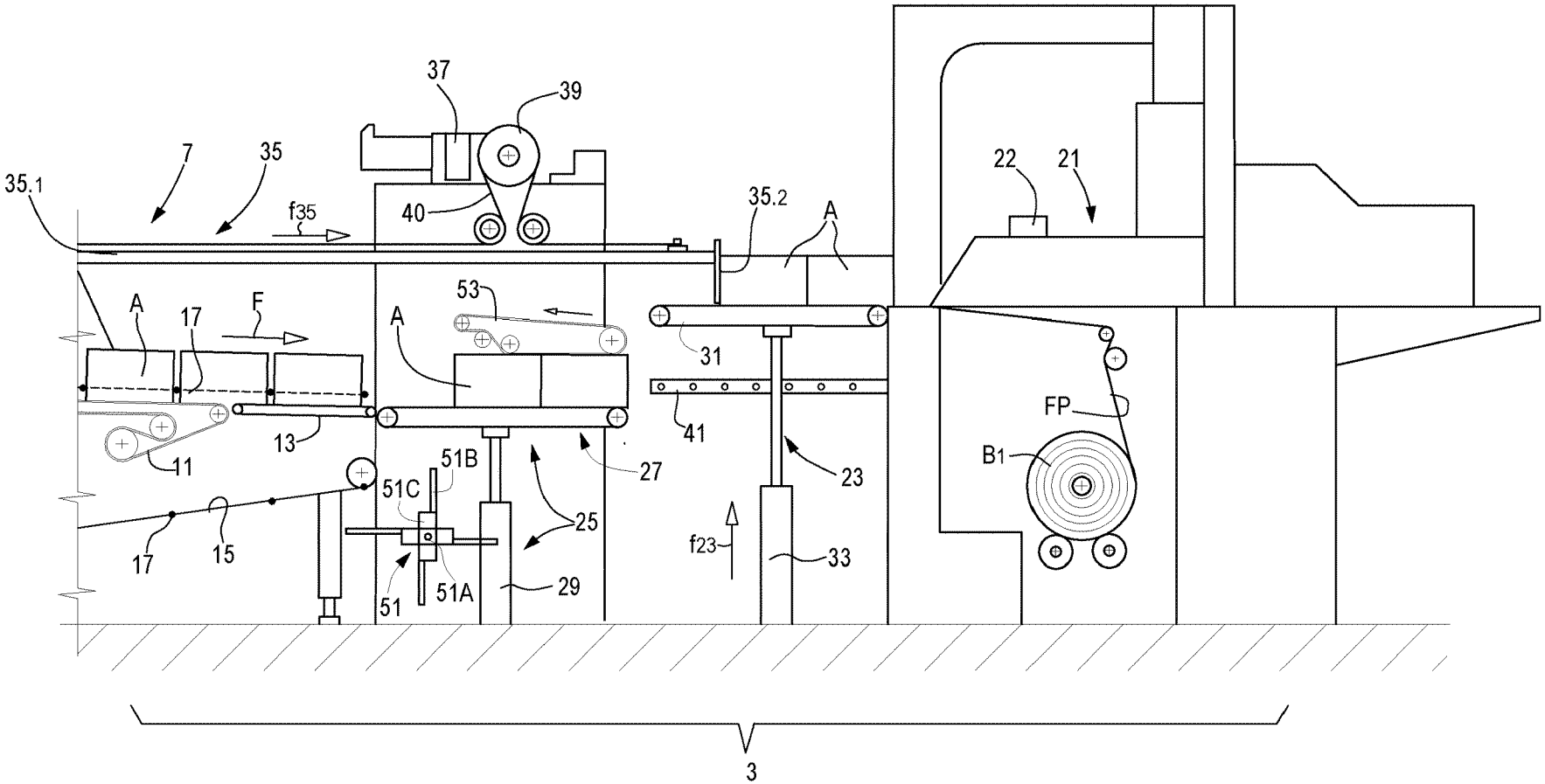
Figure 11:
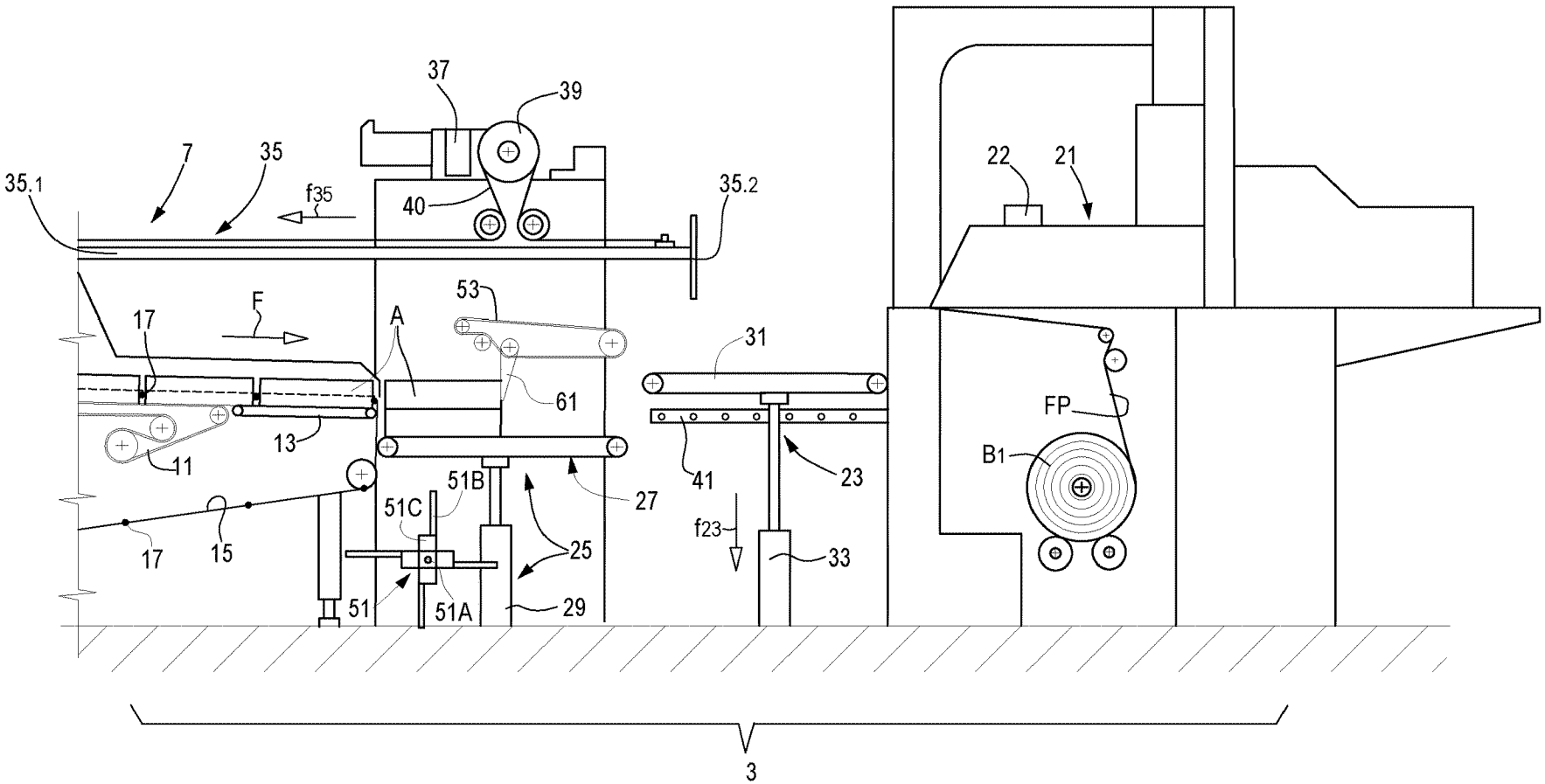
FIGS. 11, 12, 13, 14 show the operating sequence of the packaging machine in yet another operating mode.
Figure 12:
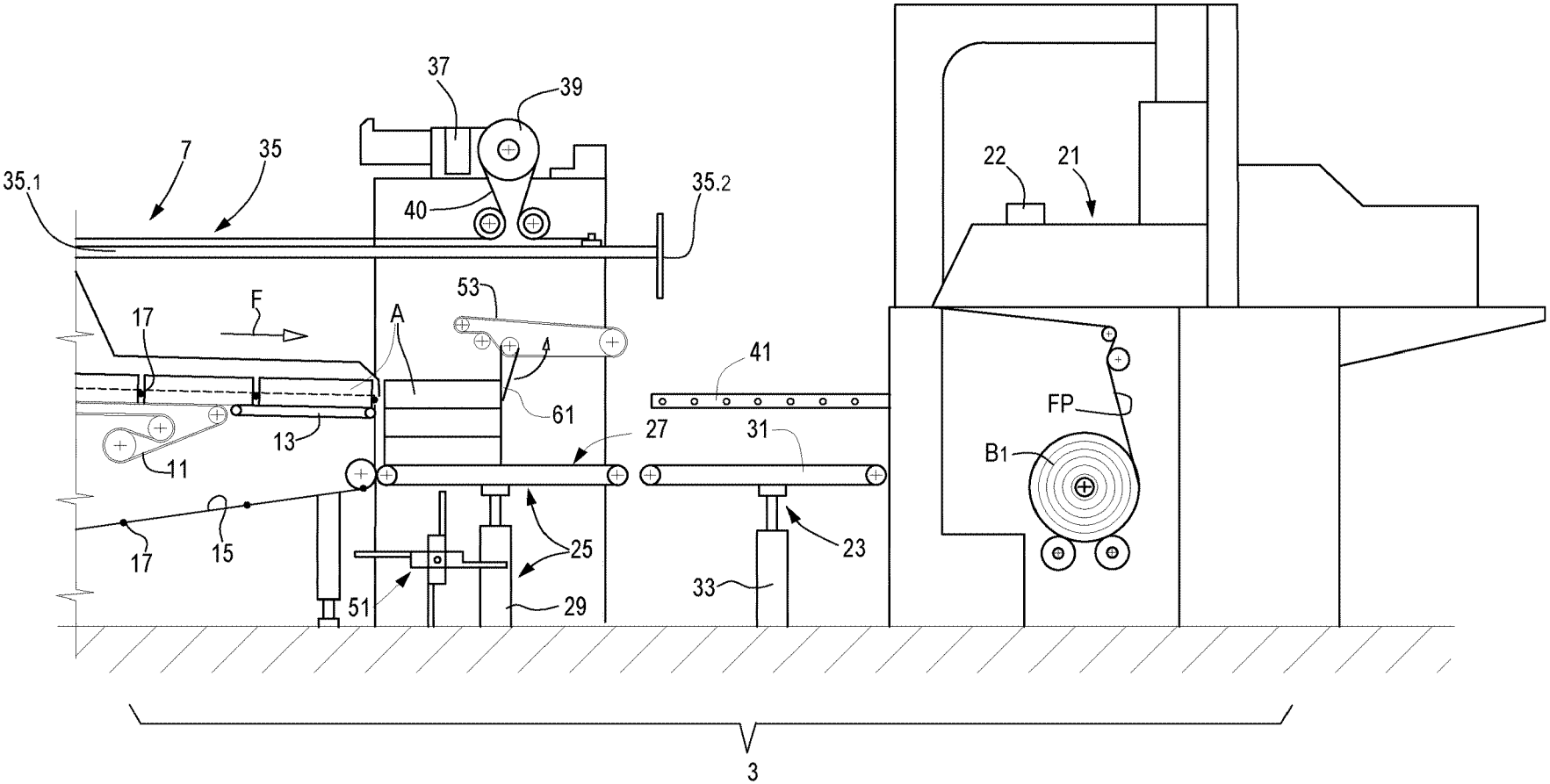

When the machine 3 requires to handle articles A that must not be upended from a horizontal position to a vertical position, the machine can be set up as illustrated in FIGS. 8 to 10. The upender 51 has been withdrawn, i.e., taken to a position lower than the height of the feed conveyor 7. If necessary, to reduce its overall dimension in the withdrawn position, the upender 51 can be partially disassembled, removing the radial arms 51B from a central support or core 51C rotating around the horizontal rotation axis 51A of the upender 51.

In the sequence of FIGS. 8, 9 and 10, groups of two articles aligned with one another are formed, which must be inserted into the wrapping tunnel 21. More in particular, purely by way of example, in FIG. 8 two articles A are aligned on the elevator 23 and this latter can start its lift stroke. On the auxiliary conveyor 27 a subsequent article A starts to be transferred from the feed conveyor 7. In FIG. 9 the elevator 23 has started its lift stroke. The pusher 35 has started its forward stroke toward the wrapping tunnel 21, by an extent determined by the size of the group of articles A detected by the detection system 41. Two articles A aligned according to the direction F are located on the auxiliary conveyor 27.

In the event that the pusher 35 is retracted in a position closer to the wrapping tunnel 21, depending upon the size of the group of articles A, the pusher 35 is stationary and waits until the elevator 23 finishes or is about to finish its stroke toward the highest position, i.e. aligned with the wrapping tunnel 21. In this step the pusher 35 can start its stroke pushing the group of articles A inside the wrapping tunnel 21 as shown in FIG. 10.

In FIG. 10 the pusher 35 is pushing the articles A located on the elevator 23 into the wrapping tunnel 21, while the two articles A located on the auxiliary conveyor 27 are taken toward the outlet area of the conveyor and are located between the auxiliary conveyor 27 and the conveyor belt 53.

It must be understood that the operating sequence of FIGS. 8 to 10 is purely an example and can differ with respect to the sequence illustrated.

In practice, in the operating mode illustrated in FIGS. 8 to 10 the multi-function station 25 operates simply as transfer device from the feed conveyor 7 to the elevator 23.

The sequence of FIGS. 11 to 14 illustrates a further operating mode of the packaging machine 3. Also, in this operating mode the upender 51 is in a withdrawn position and can be partially disassembled, i.e., the arms 51B can be removed from the central support 51C.

There can be associated with the auxiliary conveyor 27 a movable stop 61, whose position along the direction represented by the direction F of advance of the articles A can be adjusted as a function of the longitudinal size of the articles A.

In this operating mode, stacked articles A must be inserted into each pack formed by the plastic film FP by means of the wrapping tunnel 21. More in particular, as shown in FIGS. 11 to 14, stacks of three articles A vertically superimposed on one another are provided. Stacking of the articles A is carried out on the auxiliary conveyor 27. In this case, the multi-function station 25 performs the function of layering or stacking device. The movable stop 61 is used to stop each article A coming from the feed conveyor 7 in the correct position to allow stacking, i.e., layering. The stop 61 may have a length that also stops the articles A of the layer previously arranged on the auxiliary conveyor 27. For this purpose, it is sufficient for the length of the stop 61 to at least partially engage, in the direction of the arrow F, the top layer of articles A of the stack being formed on the auxiliary conveyor 27. This prevents jamming that could be caused by sliding friction between a single article A being layered and those already layered.

In fact, sliding friction generated during layering generates a force that could move the stack of articles layered in the direction of the arrow F. The single articles A coming from the feed conveyor 7 are mutually superimposed on the auxiliary conveyor 27, lowering this latter in vertical direction as the articles A arrive from the feed conveyor 7, as can be understood from the sequence of FIGS. 11 and 12. The vertical lowering stroke of the auxiliary conveyor 27 takes place in steps corresponding to the height, i.e., to the vertical size, of the articles A to be stacked.

Figure 13:
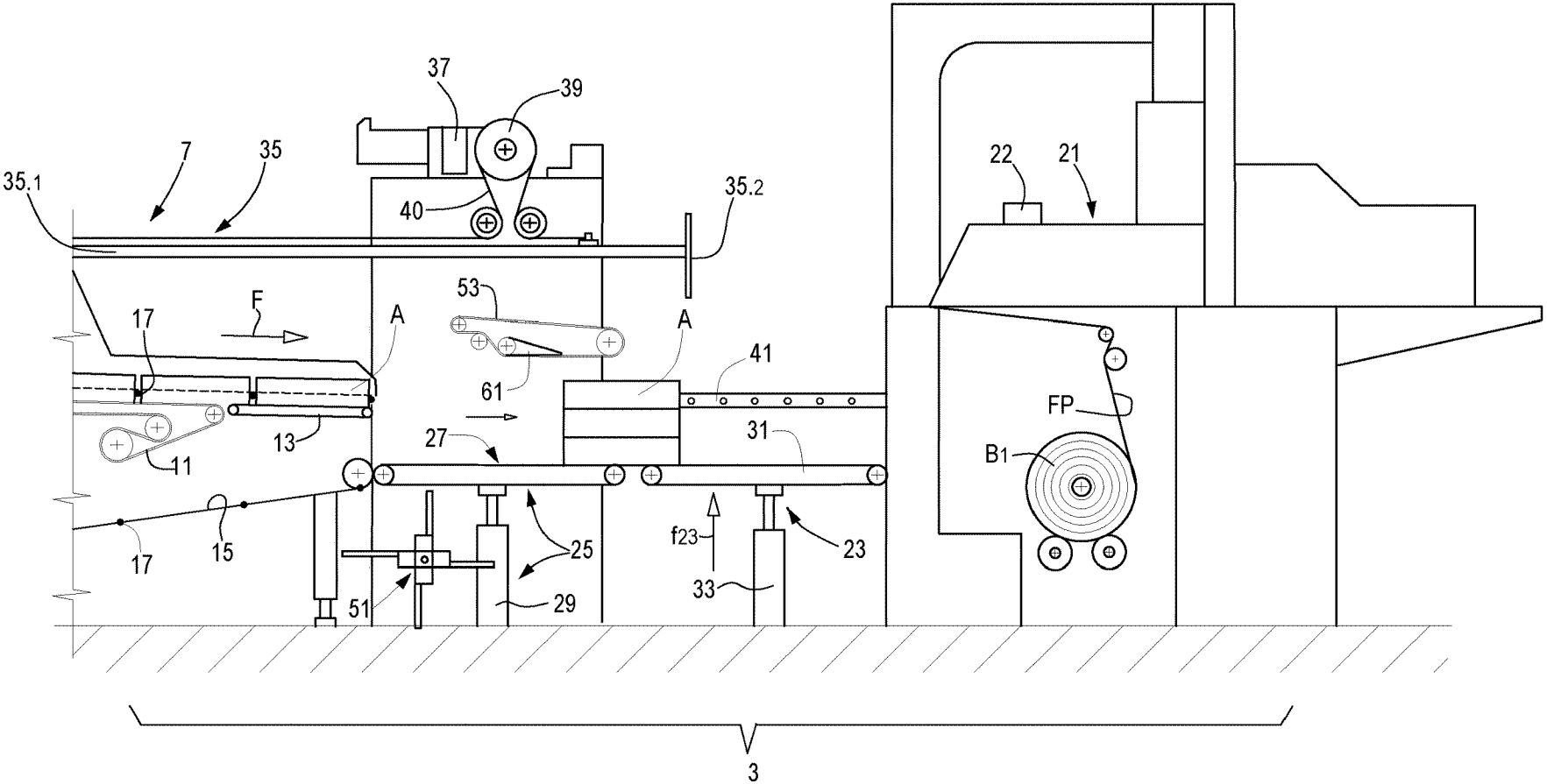

Once a stack of vertically superimposed articles A has been formed on the auxiliary conveyor 27 functioning as stacker, this stack of articles A is transferred from the auxiliary conveyor 27 to the elevator 23, which has been positioned at a height corresponding to the height of the auxiliary conveyor 27, as shown in FIG. 13. This height depends on the number of layers of which a stack of articles A is composed and on the vertical size, i.e., the thickness, of each article A.

Figure 14:
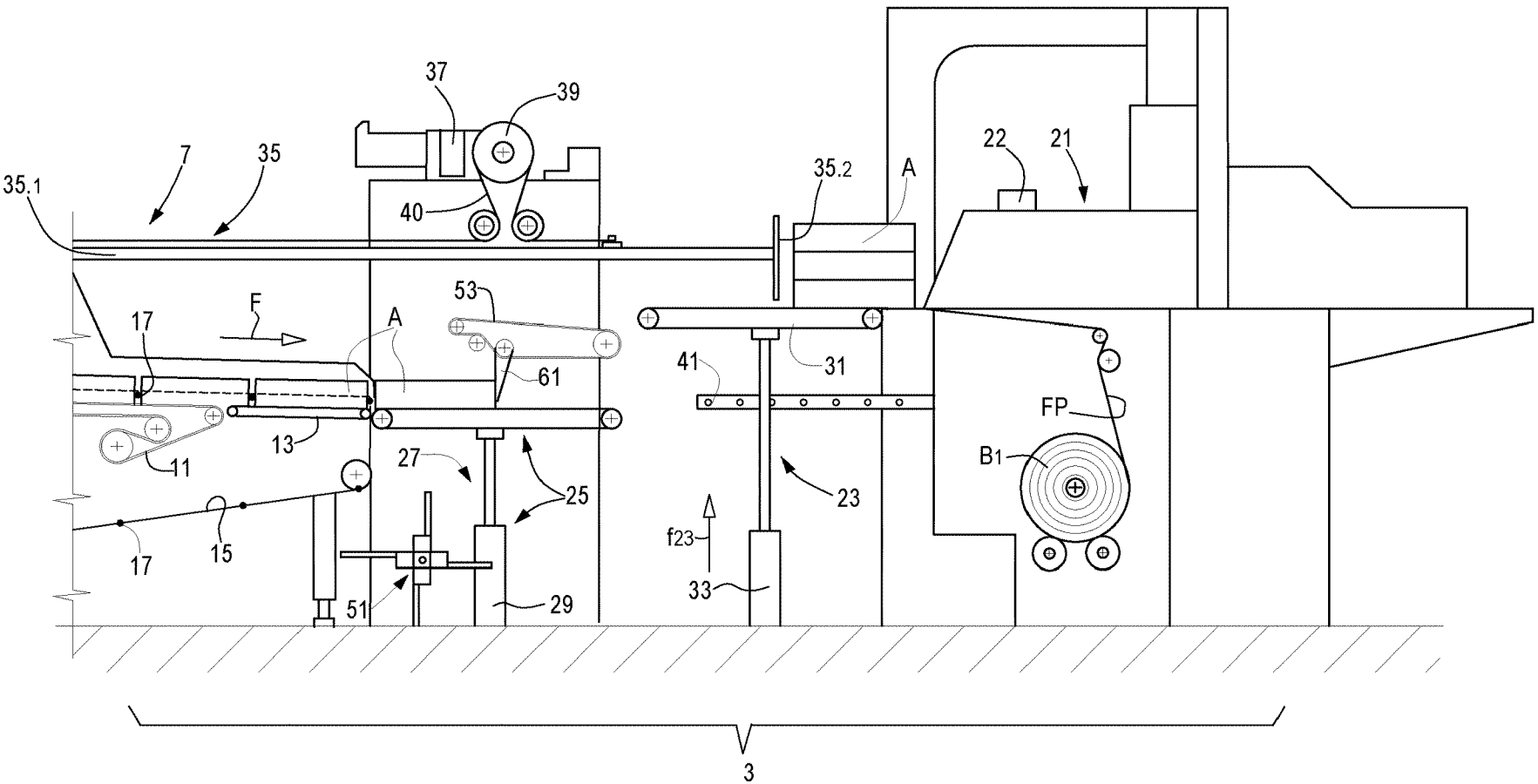

The stack of articles A to be packaged can then be transferred by means of the conveyer belt 31 of the elevator 23 into the position closest to the wrapping tunnel 21, so that the longitudinal size according to the arrow F of the group of articles A to be packaged can be detected by the detection system 41, to allow the pusher 35 to start its forward stroke toward the wrapping tunnel 21 while the elevator 23 carries out its lift stroke until reaching the position of FIG. 14. When the elevator 23 is at the height of the wrapping tunnel 21, the pusher 35 is already partially advanced toward the wrapping tunnel 21, so that its further movement forms a useful stroke to push the stack of articles A into the wrapping tunnel 21, thereby reducing the cycle time, in the same way as described with reference to the previous operating modes.

Also in this case, if the pusher 35 starts its stroke to push the group of articles A from a more advanced position according to the arrow F (previously calculated by the programmable electronic control unit 47), it is necessary to wait until the elevator 23 has terminated or almost terminated the lift stroke, i.e., has reached the height of alignment with the wrapping tunnel 21.

While the stack di articles A is being inserted into the wrapping tunnel 21, a new stack of articles A can start to be formed on the auxiliary conveyor 27 of the multi-function station 25. For this purpose, the auxiliary conveyor 25 can be taken to the outlet height of the articles A from the feed conveyor 7 and the stop 61 can be positioned in its vertical configuration, after having been retracted in a horizontal position (FIG. 13) to allow the previous stack of articles A to move from the auxiliary conveyor 27 to the elevator 23.

Figure 15:
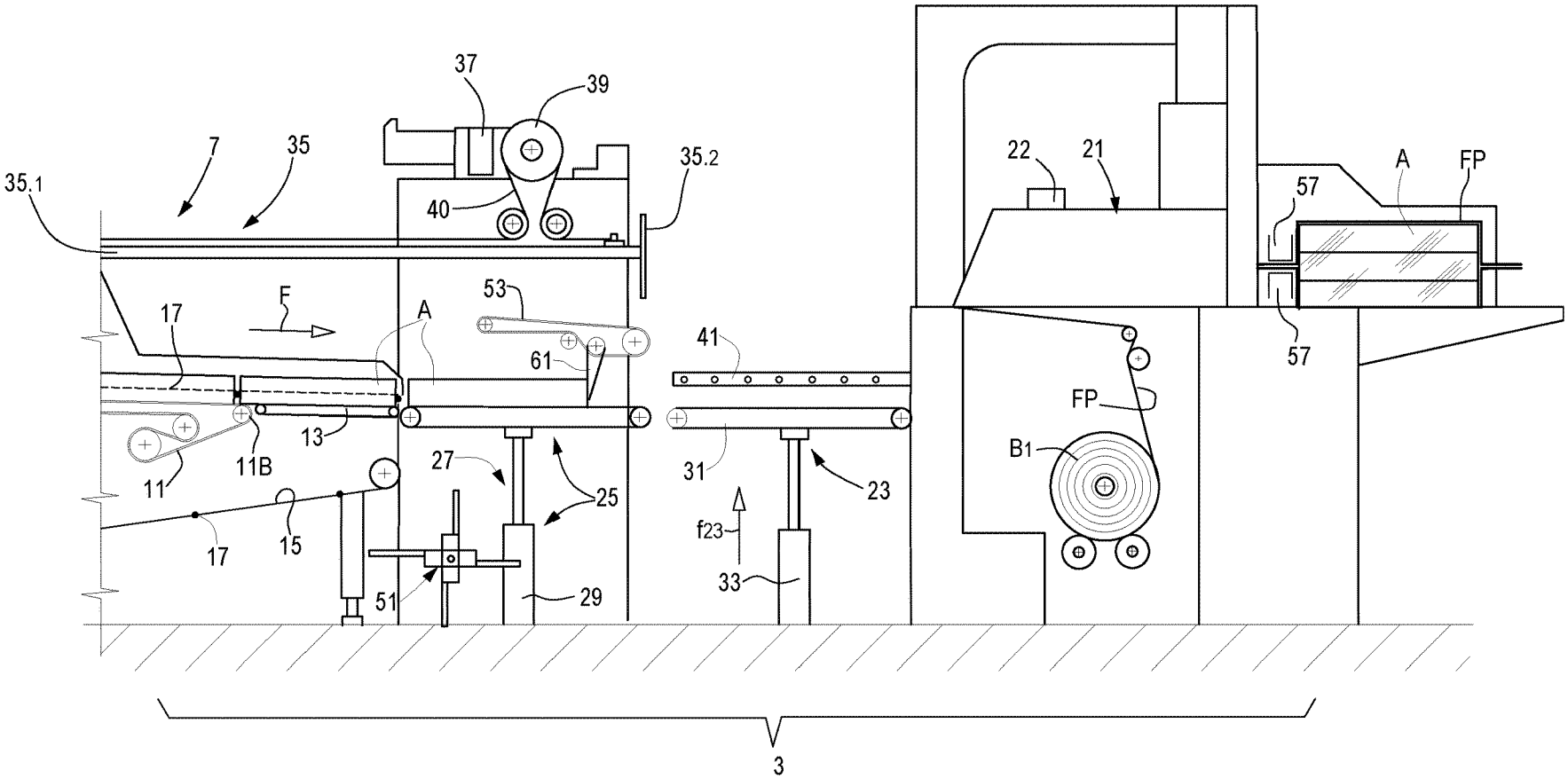
FIG. 15 shows the packaging machine of the present description in a further operating mode.

The longitudinal size, i.e., the size according to the direction of arrow F, of the articles A of FIGS. 11, 12, 13 and 14 can be variable. FIG. 15 shows an example in which the articles A to be stacked have a length, i.e. a size in direction F, greater than the length of the articles of FIGS. 11 to 14. The stop 61 has been positioned with an adjustment movement according to the direction of the arrow F to define the correct stop position of each article A unloaded from the feed conveyor 7 onto the auxiliary conveyor 27.

While FIGS. 3 to 15 represent a side view with a limited number of articles for each group to be packaged, it can be understood from the plan view of FIG. 2, that in actual fact each group of articles A to be inserted into the wrapping tunnel 21 can comprise several articles A aligned according to the transverse direction with respect to the direction F of advance of the articles.

In optimized configurations of the packaging machine 3 it is possible to adjust the unloading height of the feed conveyor 7 and therefore also of the auxiliary conveyor 27, as a function of the height of the group of articles A to be packaged, so as to minimize the lift stroke of the elevator 23. The programmable electronic control unit 47 calculates the height of the product to be packaged as a function of the group of articles A and arranges the packaging machine 3 so that a higher height of the outlet of the feed conveyor 7, of the auxiliary conveyor 27 and of the elevator 23 correspond to groups of articles A of lower height, and vice versa. In this way the cycle of the machine is optimized, as the elevator 23 always requires performing the shortest possible stroke to align a group of articles A with the wrapping tunnel 21.

Figure 16:
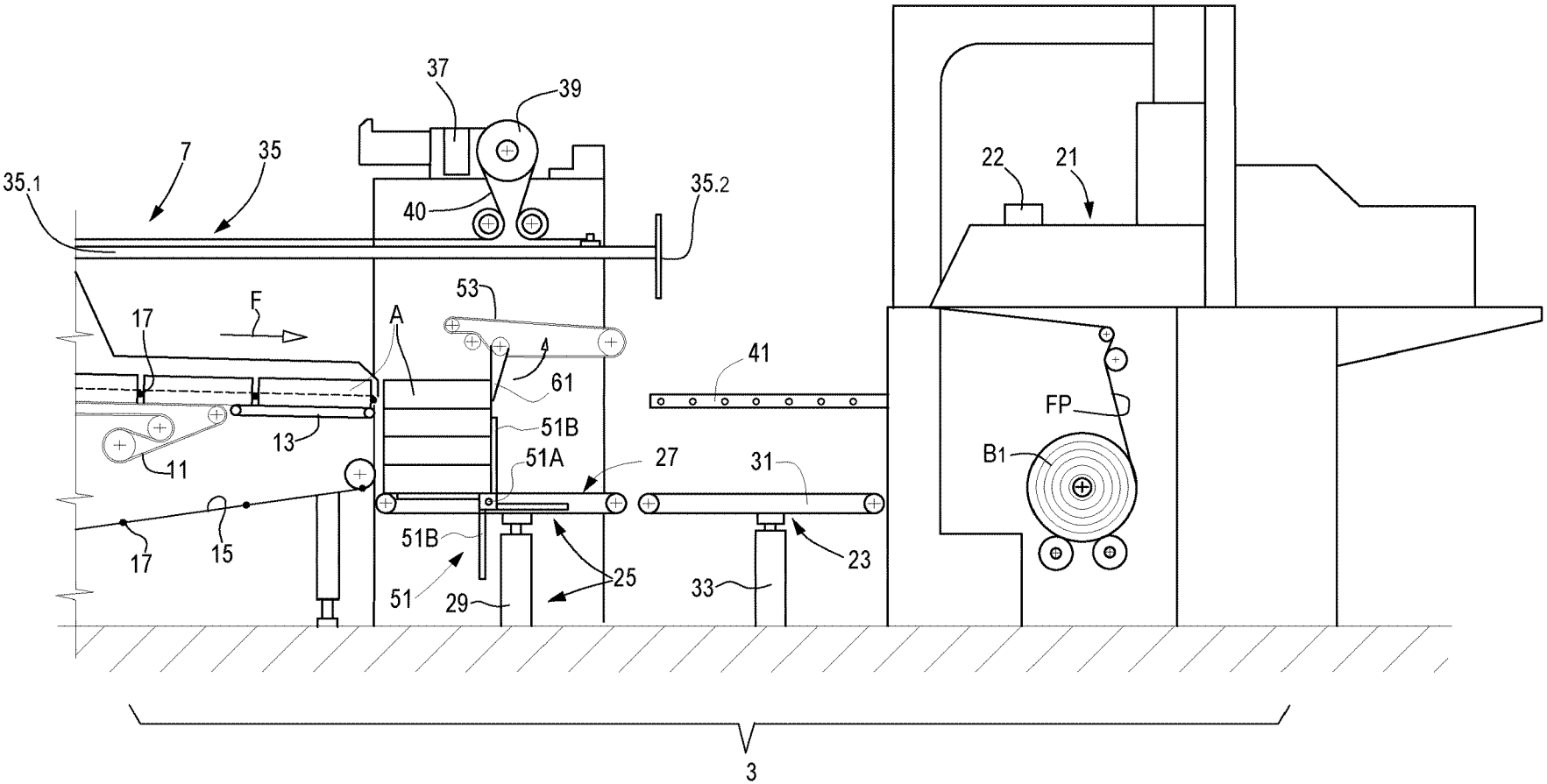
FIG. 16 shows a side view of a station of the packaging machine in a further operating mode.

FIG. 16 shows a view of the packaging machine 3 in a step of a work cycle of a different operating mode. The same numbers indicate the same or equivalent parts to those already described with reference to the preceding figures, in particular FIGS. 11 to 14. In this embodiment, the multi-function station 25 functions as layering or stacking device. In the example illustrated, a stack of four superimposed articles A is formed. To also retain the lowest articles A in the stack during stacking of the subsequent articles, in addition to the movable stop 61, the upender 51 is also used. In this operating mode, the upender 51 functions as lower stop that co-acts with the movable stop 61. The upender is in this case moved with a vertical translation movement, to follow the lowering movement of the auxiliary conveyor 27, but is not provided with rotation motion. One of the arms 51B is kept in a position corresponding to the stop point of the articles A, substantially aligned vertically with the position of the movable stop 61. As can be observed in FIG. 16, the first two articles A of the stack, i.e., the two lower articles, are held in place by the stop formed by the arms 51B, while the upper article A, i.e. the last one deposited on the stack, is held by the stop 61. When the stack is complete, the upender 51 can be lowered with a translation movement until the arms 51B are withdrawn under the surface defined by the auxiliary conveyor 27, so as to allow transfer of the stack of articles A toward the elevator 23.

Figure 17:
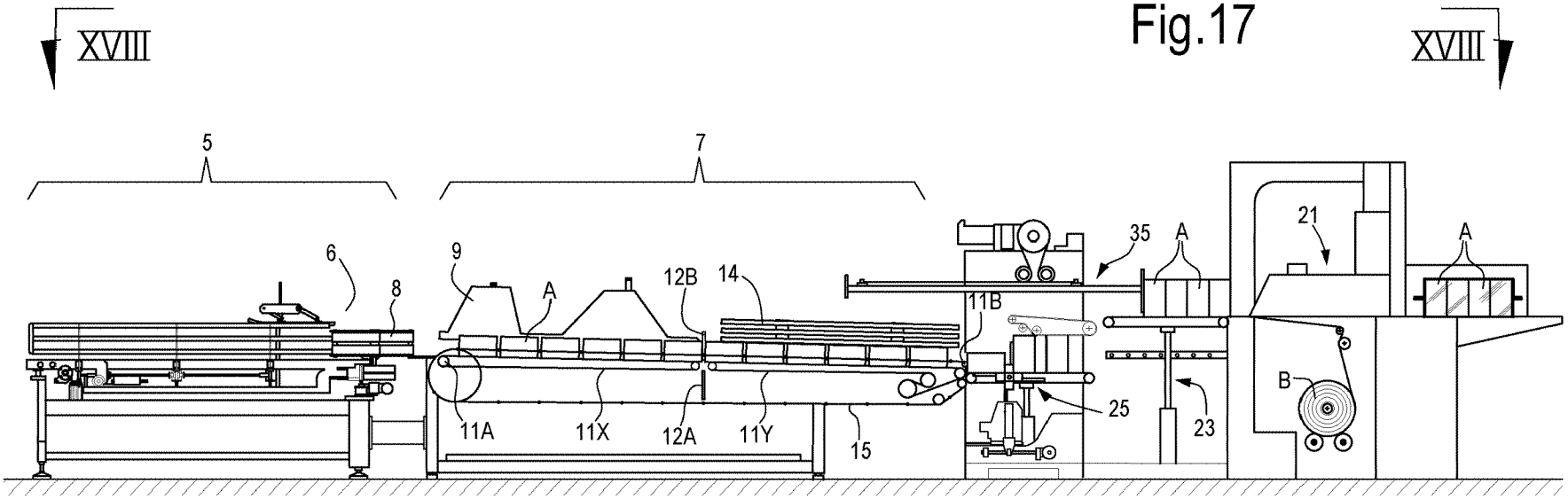
FIGS. 17 and 18 show a side view and a plan view analogous to FIGS. 1 and 2, of a further embodiment.
Figure 18:
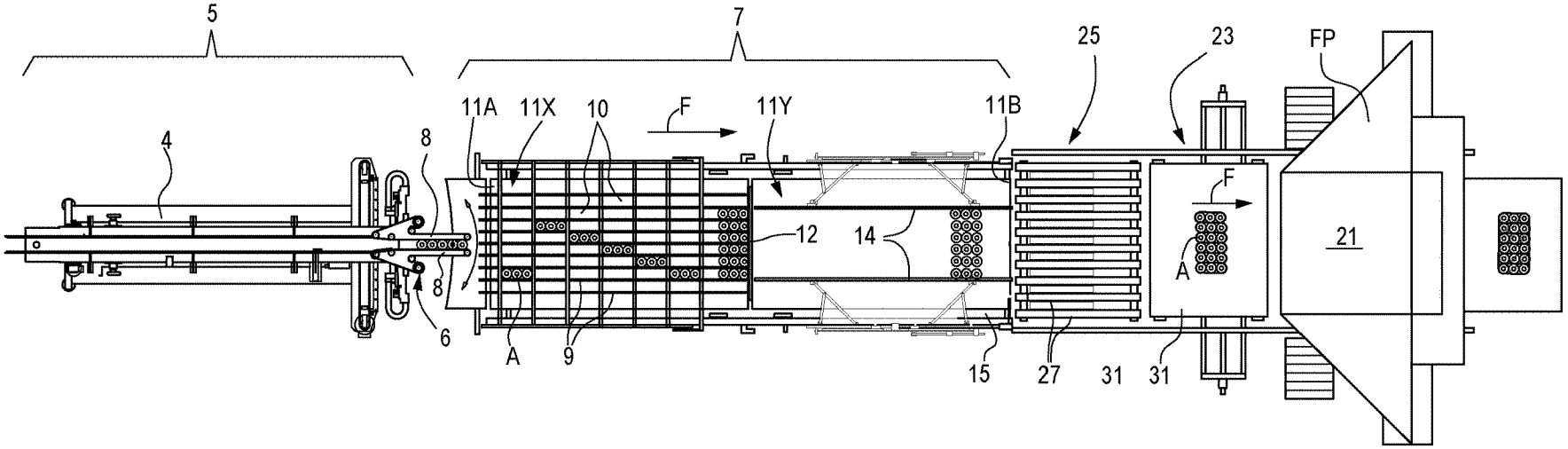

FIGS. 17 and 18 show, in the same way as FIGS. 1 and 2, a top view and a side view of a portion of packaging line in a further embodiment. The same numbers indicate parts the same as or corresponding to those previously described. These parts will not be described again. In the embodiment of FIGS. 17 and 18 the diverter or distributor 5 has a horizontal conveyor 4 and a launching head 6 positioned at the downstream end of the distributor 5. The launching head can comprise two vertical conveyor belts 8 that define therebetween a space for passage of the articles A to be packaged. The purpose of the launching head 6 is to transfer the articles A into the various channels 10 in the feed conveyor 7.

Advantageously, the conveyor belts 8 of the distributor or diverter 5 can project in a cantilever fashion with respect to the conveyor 4 of the distributor 5. In this way, transfer of the single articles A from the distributor 5 to the feed conveyor 7 is facilitated. This is particularly useful as the distributor 5 is provided with a pivoting motion (arrow f5 in FIGS. 5 and 18) around a horizontal axis. Therefore, the distance of the launching head 6 with respect to the feed conveyor 7 is variable. Having the launching head 6 cantilevered with respect to the conveyor 4 of the oscillating distributor 5 it is possible to accompany each article A into the respective channel 10 even when the pivoting distributor 5 is in one of the two end positions, i.e., a position of maximum inclination with respect to the centerline of the packaging line 1.

The characteristics of the distributor 5 described above can also be used in the embodiment described with reference to FIGS. 1 and 2.

By way of example, the embodiment of FIGS. 17 and 18 has a configuration of the feed conveyor 7 different from the configuration shown in FIGS. 1 and 2. This different configuration of the conveyor 7 can be used with a distributor 5 as illustrated in FIGS. 17 and 18, or in combination with the elements illustrated in FIGS. 1 and 2.

In brief, the feed conveyor 7 illustrated in FIGS. 17 and 18 comprises two conveyor belts 11X, 11Y arranged in sequence, instead of a single conveyor belt 11 as shown in FIGS. 1 and 2. The side walls 9 are positioned above the first conveyor belt 11X, while arranged above the second conveyor belt 11Y are compactor elements 14, the purpose of which is to bring together the articles A that are inserted into the single channels 10 formed between the mutually parallel lateral side walls 9.

In some embodiments, a vertically movable partition, indicated schematically with 12, can be arranged between the first conveyor belt 11X and the second conveyor belt 11Y. The partition 12 is periodically lifted and lowered during advance of the articles A. When the partition 12 is lifted (position 12B in FIG. 17), it forms a stop for the articles A that are distributed sequentially by the distributor 5 in the single channels 10, while the distributor 5 carries out the pivoting movement f5. When the partition 12 is in the lowered position (12A in FIG. 17) it allows transfer of the articles A.

Due to the partition 12, the single articles distributed in the various channels 10 are accumulated as a result of the forward movement imparted by the conveyor belt 11X against the partition 12. Once all the articles A that are to form a single group to be packaged have been distributed and are correctly accumulated against the partition 12, this latter can be lowered to allow the articles A to continue advancing from the conveyor belt 11X toward and onto the conveyor belt 11Y.

A particularly advantageous embodiment of the multi-function station 25 represented schematically in the preceding figures is shown in the subsequent FIGS. 19 to 25. In these figures some components of the multi-function station 25 mentioned in the description above have been omitted, in particular the flexible member 53, and the stop 61. It must be understood that these elements can also be provided in the multi-function station 25 according to the embodiment of FIGS. 19 to 25.

In FIGS. 19 to 25 the multi-function station 25 comprises a load bearing structure 71, carrying the auxiliary conveyor 27 and the upender 51, which can be movable to carry out the operations described above and/or to adjust their position.

In the embodiment illustrated here, the auxiliary conveyor 27 comprises, or consists of, a plurality of conveyor belts 27N parallel to and spaced from one another. The conveyor belts 27N are in substance arranged according to a comb arrangement, to allow the arms 51B of the upender 51, also having a comb arrangement but offset with respect to that formed by the conveyor belts 27N, to move above the transport surface for the articles A defined by the auxiliary conveyor 27.

As shown in particular in FIG. 21, the assembly of conveyor belts 27N that form the auxiliary conveyor 27 can be carried by a structure 73 that is vertically movable with respect to the load bearing structure 71. The movement is indicated by the double arrow f27. The vertically movable structure 73 can comprise a horizontal beam 75 constrained to an upright 77 (see in particular FIG. 22). The upright 77 is guided in a guide 79 that can be integral with the load bearing structure 71, for example with a transverse beam 81 that is part of the load bearing structure 71.

The vertical movement (arrow f2) of the upright 77 and of the horizontal beam 75 is given by a motor 76 (see in particular FIG. 20) that rotates a drive pulley 78 (see in particular FIG. 22). An open belt 80 is guided around the pulley 78. The two ends 80A and 80B of the belt 80 are constrained in different points, vertically spaced from one another, of the upright 77. The rotation in one direction or the other of the pulley 78 controlled by the motor 76 in this way causes the lifting and lowering movement of the vertically movable structure 73 and of the auxiliary conveyor 27 mounted thereon.

The horizontal beam 75 has integral side elements 83 that support a motorized roller 85, which controls the advance motion of the conveyor 27. In the embodiment illustrated, the motorized roller 85 is driven in rotation by a motor 87 (see in particular FIGS. 19 and 20). The motor 87 can be carried by a lateral side element 89 integral with the load bearing structure 71. The motor 87 controls a drive pulley 91 around which an endless belt 93 is guided. The belt 93 is also guided around idle pulleys 95, 97, 99 and around a driven pulley 101, mounted on the supporting shaft of the motorized roller 85. The motor 87 can in this way transmit the rotation motion to the motorized roller 85 allowing this latter to move vertically according to the double arrow f27, integral with the vertically movable structure 73, while the motor remains stationary with respect to the load bearing structure. With this arrangement it is possible to move the auxiliary conveyor 27 vertically without moving the motor 87 vertically.

The possibility is not ruled out, to mount the motor 87 on the vertically movable structure 73, in this way making the motor 87 participate in the lifting and lowering motion of the auxiliary conveyor 27.

Figure 23:
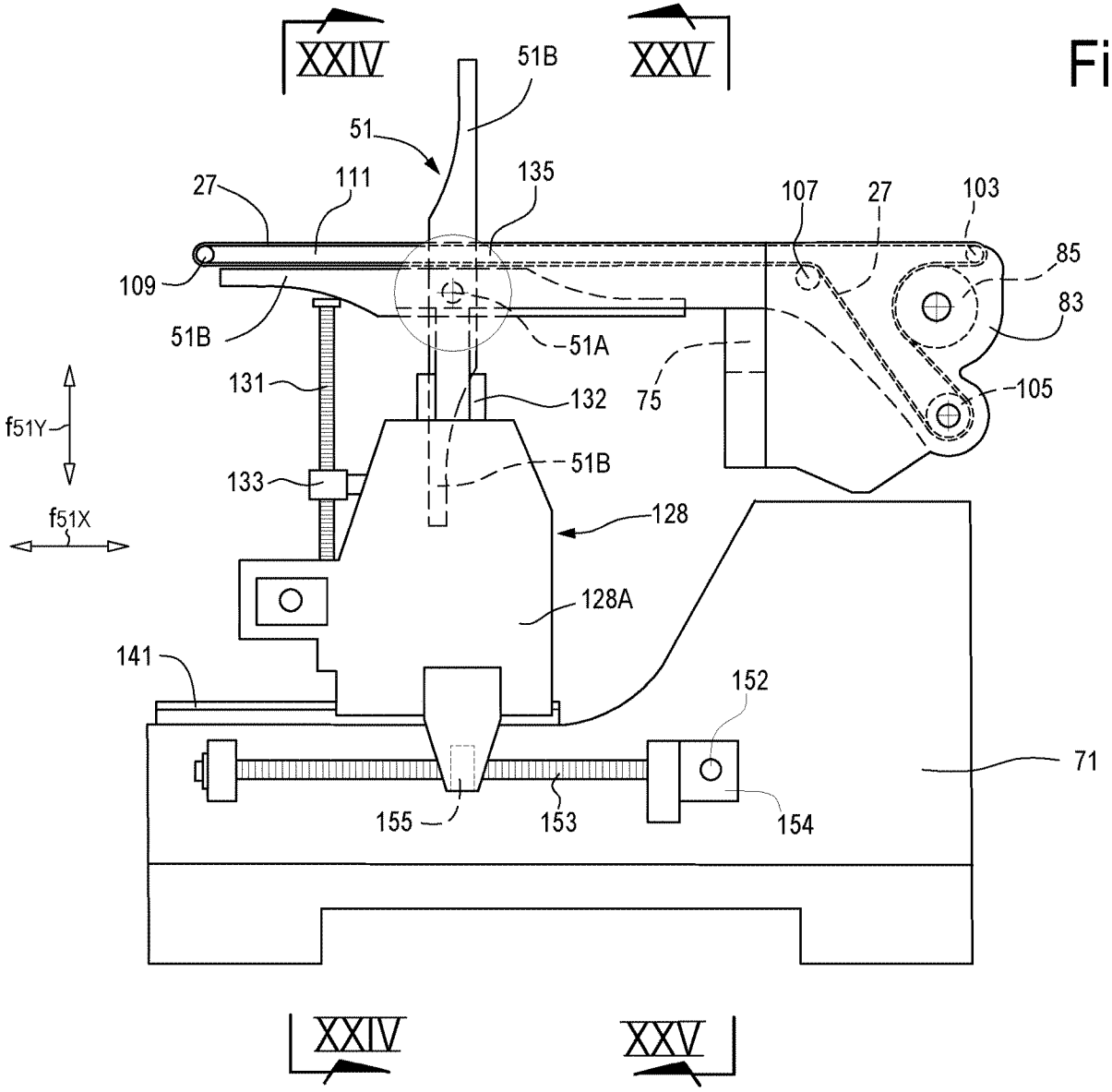
FIG. 23 shows a view according to the line XXIII-XXIII of FIG. 19.
Figure 24:
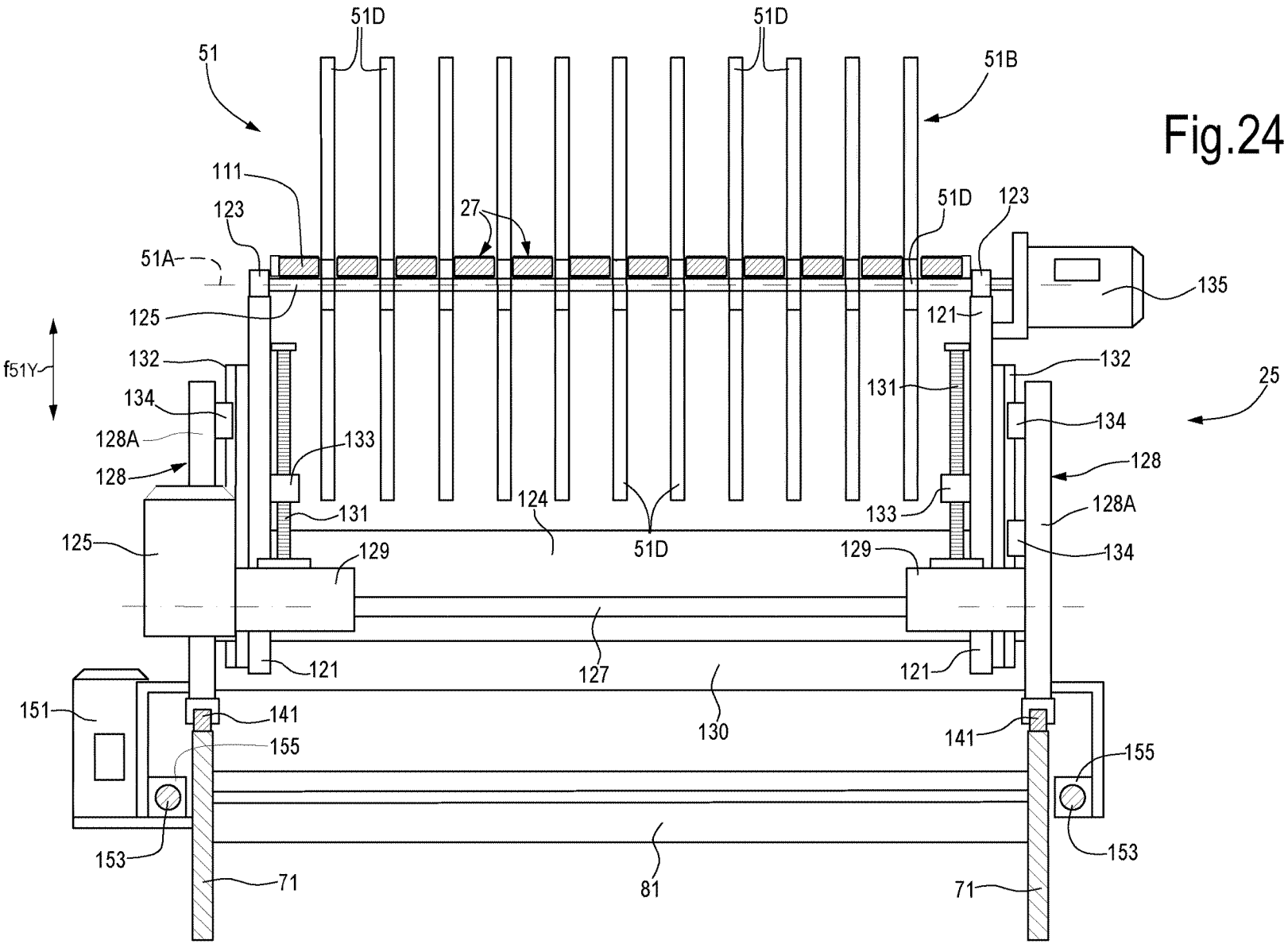
FIG. 24 shows a view according to the line XXIV-XXIV of FIG. 23.
Figure 25:
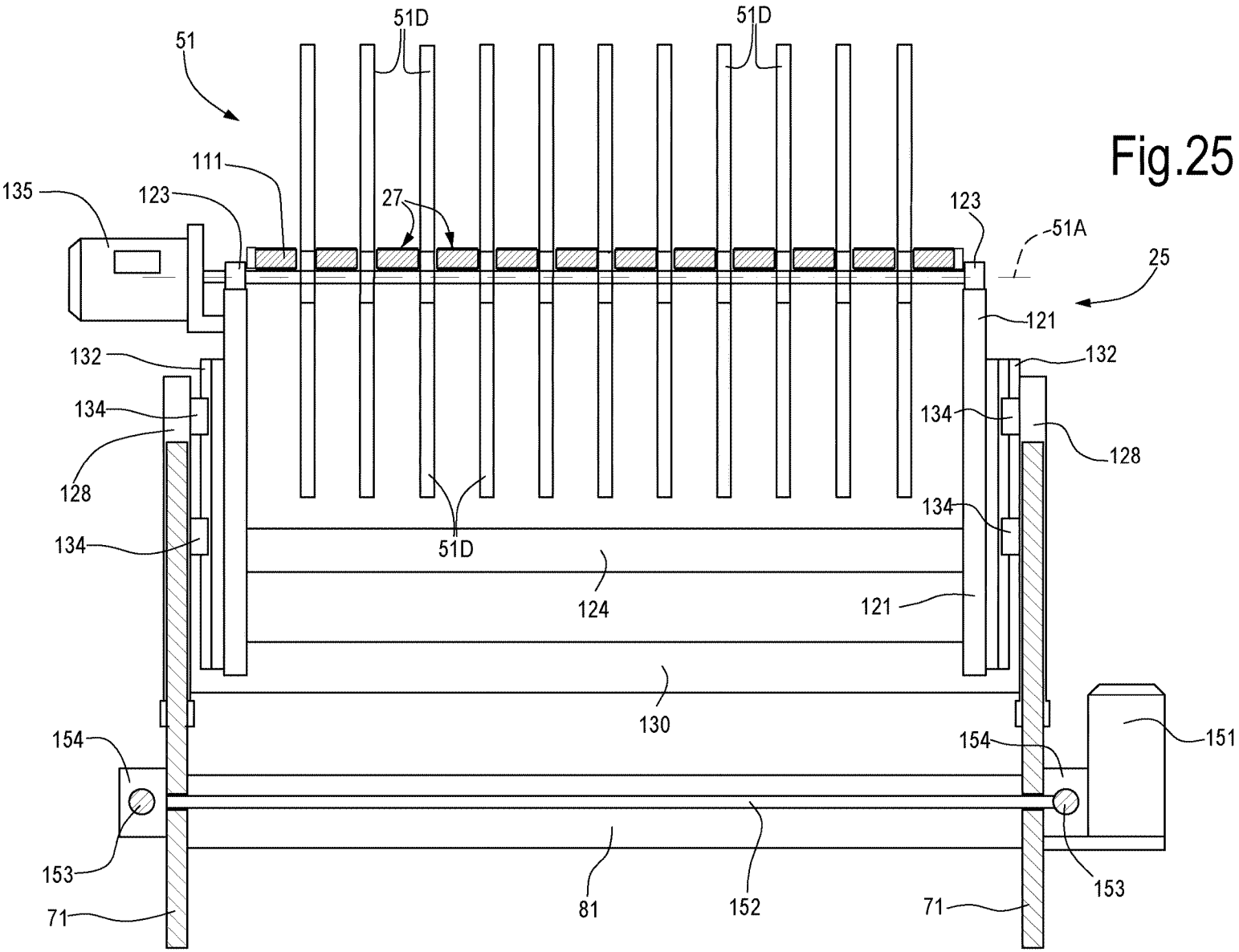
FIG. 25 shows a view according to the line XXV-XXV of FIG. 23.

Each conveyor belt 27N of the auxiliary conveyor 27 is guided around the motorized roller 85 and also around pulleys 103, 105, 107 and 109 (see in particular FIG. 23). The pulleys 109 can each be supported separately from one another at the end of a respective linear element 111. The linear elements 111, parallel with one another associated with the single conveyor belts 27N, form a comb structure mounted in a cantilever fashion on the beam 75 and oriented toward the area from which the articles A to be packaged arrive. The auxiliary conveyor belt 27 thus has a comb structure, each prong whereof is formed by a conveyor belt 27N and by its linear element 111.

In the embodiment illustrated in FIGS. 19 to 25, the upender 51 comprises a plurality of arms 51B rotating around a horizontal axis 51A substantially orthogonal to the direction of movement of the articles A, in accordance with what was described previously with reference to the preceding figures.

As can be seen in particular in FIGS. 19, 21, 24 and 25, each arm 51B has a comb structure, with prongs labeled 51D. The prongs 51D are spaced from one another in a transverse direction, i.e., parallel to the horizontal rotation axis 51A of the upender 51, so as to be able to be inserted between the conveyor belts 27N that form the auxiliary conveyor 27. Therefore, in practice the comb structures of the arms 51B and of the auxiliary conveyor 27 have prongs inserted between one another.

As the conveyor belts 27N are guided around pulleys supported by the linear elements 111, at least in the front part, i.e. the part facing the area from which the articles A arrive, the space between adjacent conveyor belts 27N is completely free and this allows passage of the prongs 51D forming the arms 51B.

In the embodiment illustrated in FIGS. 19 to 25 the upender 51 can move in horizontal and vertical direction to take various operating positions and perform one or other of the functions mentioned above with reference to the various operating modes illustrated in the figures described previously. The movements in horizontal and vertical direction of the upender 51 are indicated by the double arrows f51$x$ and f51$y$, respectively.

To move the upender 51 vertically, it can be carried by a vertically movable assembly. The assembly can comprise vertical uprights 121 (FIG. 24), the upper ends of which can be provided with supports 123 for a horizontal shaft 125, approximately orthogonal to the direction of advance of the articles A. The axis of the shaft 125 represents the rotation axis 51A of the upender 51. The prongs 51D forming the arms 51B of the upender 51 can be made integral with the shaft 125.

The uprights 121 can be joined to one another by a lower cross member 124 and in this way form the assembly which is vertically movable according to the double arrow f51$y$. The vertical movement f51$y$ can be controlled by a motor 125 that rotates a transverse shaft 127 carried by a carriage 128 (FIG. 24) comprising lateral side elements 128A connected to one another by a cross member 130. The shaft 127 is associated with two bevel gear members 129, also carried by the carriage 128, which transmit the rotation motion of the transverse shaft 127 to two vertical threaded bars 131. The two threaded bars 131 are each associated with one of the uprights 121. Screw nuts 133 that mesh with the respective threaded bars 131 are constrained to the uprights 121. In this way, rotation of the motor 125 in one direction or the other causes lifting or lowering of the assembly 121, 124 that supports the upender 51, which is vertically movable according to the double arrow f51$y$.

The vertical movement of the vertically movable assembly 121 can be guided by means of guides 132 integral with the uprights 121 and engaged in sliding blocks 134 integral with the lateral side elements 128A of the carriage 128.

The rotation movement of the upender 51 around the horizontal axis 51A can be controlled by a motor 135, constrained to one or other of the uprights 121 or in any case made integral with the vertically movable assembly 121, 124 so as to move integral with the shaft 125 of the upender 51.

The horizontal movement of the upender 51 can be obtained by moving the carriage 128 along guides 141 integral with the load bearing structure 71. The guides 141 extend horizontally in a direction substantially parallel to the direction of advance of the articles A to be packaged.

The horizontal movement according to the double arrow f51$x$ of the upender 51 can be obtained by moving the carriage 128 horizontally along the guides 141 by means of a motor 151 (FIG. 19, 25) that rotates, by means of a shaft 152 and two bevel gears 154 (FIG. 25), two threaded bars 153, one on each side of the load bearing structure 71. A respective screw nut 155 meshes with each threaded bar 153. Each screw nut is constrained to a respective side element 128A of the carriage 128.

With the arrangement described above the vertical and horizontal movement of the upender 51 is obtained, which can take various positions with respect to the auxiliary conveyor 27, as a function of the specific operating mode according to which the machine is operated.

Figure 19:
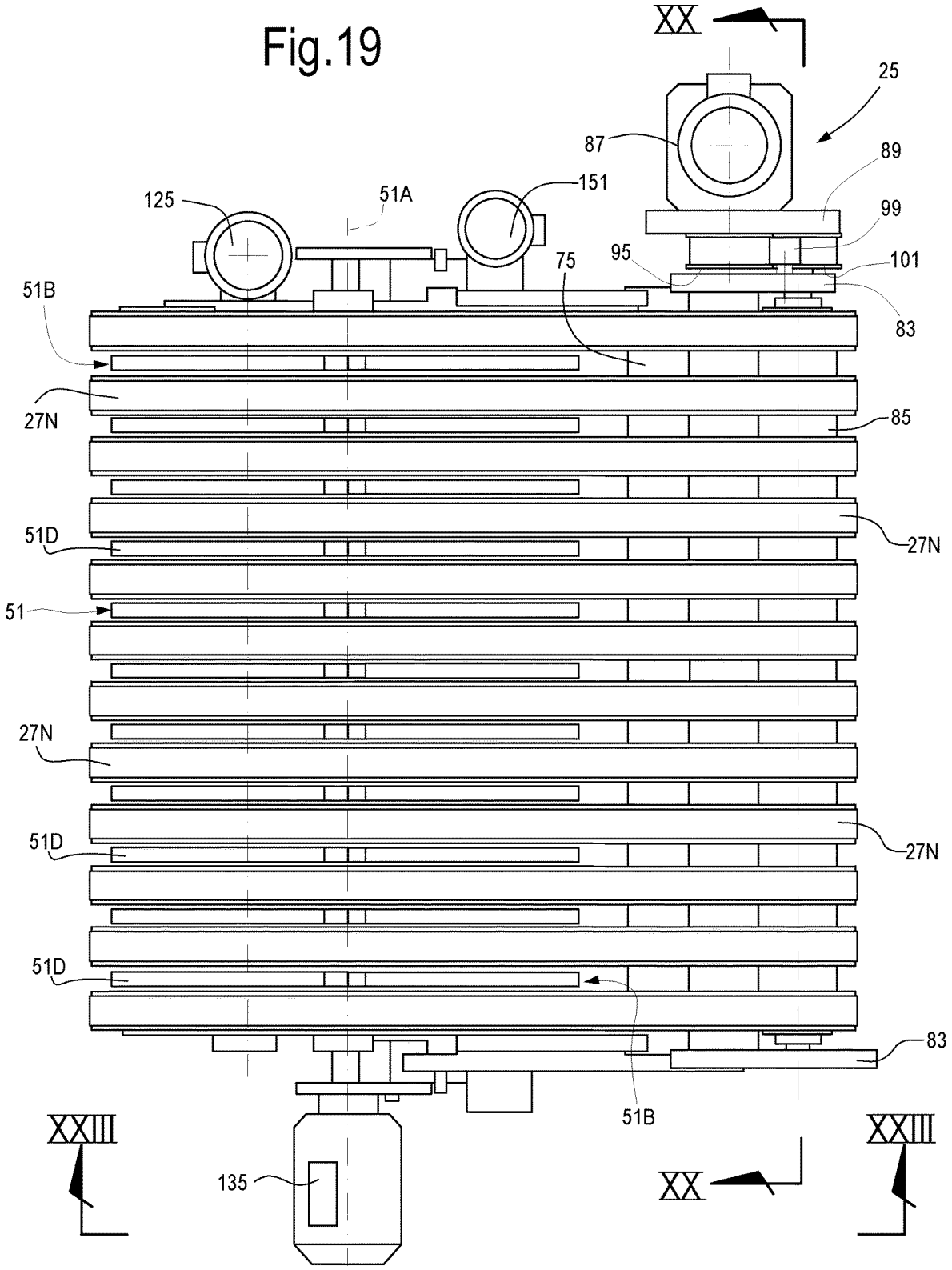
FIG. 19 shows a plan view of a further embodiment of a multi-function station that can be used in the packaging machine disclosed herein.

As can be observed in particular in FIGS. 19 and 23, the upender 51 is substantially superimposed, in plan view, with respect to the auxiliary conveyor 27 so as to occupy the same space occupied by the auxiliary conveyor inside the multi-function station 25. On the one hand this allows the overall length of the packaging line to be reduced, while on the other it allows an arrangement of members variously configured as a function of the type of pack that the user wishes to produce with the line, to be inserted in the same space (dedicated to the multi-function station 25).

In fact, if the use of an upender is not required for the type of production for which the line is destined, this latter can be omitted, with reduction of the overall cost of the line. However, if at a later date the user of the line wishes to implement further functions and produce packs of different type, the upender 51 can be installed in the same space already occupied by the auxiliary conveyor 27 of the multi-function station.

In some embodiments, it is also possible for the multi-function station 25 to be modularly inserted in and removed from the line. In fact, the load bearing structure 71 is configured to support both the auxiliary conveyor 27 and the upender 51 and the members designated for its movement. Also the members above, indicated with 53 and 61 in the preceding FIGS. 1 to 16, can be carried by the load bearing structure 71. In this way, the same load bearing structure 71, or load-bearing structures 71 with the same plan dimensions, can be variously configured with the different mechanical members described above, in more or less complex combinations, as a function of the operating modes that the final user of the line wishes to implement.

In substance, the multi-function station 25 described here is the most complex of a series of stations with a variable number of mechanical members, as a function of the type of pack to be produced.

While the embodiments described with reference to the accompanying figures are provided with a system 41 for detecting the longitudinal size of the groups of articles A to be packaged, in other embodiments, alternatively to or in combination with the system 41, the programmable electronic control unit 47 can receive input information on the shape and/or size of the groups of articles A to be packaged, also including the longitudinal size of the group of articles A, to obtain the same purpose. If the two approaches are used in combination, it is possible to use the system 41 when the programmable electronic control unit 47 does not receive input data on the longitudinal size of the groups of articles A to be packaged.

The invention claimed is:

1. A packaging machine for packaging articles in packs of plastic film, comprising:

a control unit;

a wrapping tunnel, adapted to form a tube of plastic film around a group of articles;

a feed conveyor, adapted to feed articles to be packaged toward the wrapping tunnel;

an elevator, positioned between the feed conveyor and the wrapping tunnel, and movable vertically from a lower position, to receive the articles from the feed conveyor, to a higher position, to transfer the articles to the wrapping tunnel;

a pusher to push the articles to be packaged from the elevator into the wrapping tunnel; wherein the pusher is provided with a reciprocating motion of an insertion stroke to move forward the articles into the wrapping tunnel and a return stroke to a retracted position with respect to the wrapping tunnel;

wherein the movement of the pusher is controlled as a function of the size of the group of articles to be packaged in a direction of insertion into the wrapping tunnel; and wherein the control unit is adapted to control the movement of the pusher toward the wrapping tunnel so that the pusher carries out a portion of the insertion stroke from a position of maximum retraction toward the wrapping tunnel before a lift stroke of the elevator has been completed, said portion of the insertion stroke being a function of the size of the group of articles to be packaged.

2. The packaging machine of claim 1, wherein the control unit is adapted to reduce the return stroke of the pusher, with respect to a position of maximum retraction, as a function of the size of the group of articles to be packaged.

3. The packaging machine of claim 1, wherein with the elevator, a detection system is associated for detecting the size of the group of articles and direction of feed of the group of articles to be transferred into the wrapping tunnel.

4. The packaging machine of claim 1, wherein the size of the group of articles is calculated by the control unit as a function of a format of the articles to be packaged.

5. The packaging machine of claim 1, wherein the control unit is interfaced to a detection system of the size of the group of articles, to the pusher and to the elevator.

6. The packaging machine of claim 1, wherein the control unit is configured to coordinate the movement of the pusher and movement of the elevator as a function of the size of the group of articles.

7. The packaging machine of claim 1, further comprising an auxiliary conveyor, positioned between the feed conveyor and the elevator, and an upender, associated with the auxiliary conveyor and adapted to be arranged selectively in an active position, to cooperate with the auxiliary conveyor to upend articles coming from the feed conveyor and transfer the articles upended toward the elevator, and in an idle position.

8. The packaging machine of claim 1, further comprising an auxiliary conveyor positioned between the feed conveyor and the elevator; wherein a movable stop is associated with the auxiliary conveyor, defining a stop position on the auxiliary conveyor of the articles coming from the feed conveyor, the movable stop being adapted to selectively take a withdrawn position, to allow transfer of the articles to be packaged from the auxiliary conveyor to the elevator.

9. The packaging machine of claim 1, wherein the elevator comprises a conveying member adapted to move the articles to be packaged toward the wrapping tunnel.

10. The packaging machine of claim 1, wherein the feed conveyor comprises: a main conveyor belt, with an inlet end and an outlet end for the articles to be packaged; and a continuous flexible member, carrying a plurality of transverse bars, movable along a closed path, with an active portion and a return portion, the active portion extending along a feed path of the main conveyor belt.

11. The packaging machine of claim 1, wherein the control unit is configured to define a loading height of the elevator of the feed conveyor and of an auxiliary conveyor as a function of height of the group of articles.

12. A method for packaging articles in tubular packs of plastic film comprising steps of:

feeding a plurality of articles to be packaged along a feed path toward an elevator;

forming on the elevator an orderly group of the articles to be packaged;

lifting by the elevator the orderly group of the articles to be packaged, from a lower position, at which the articles to be packaged are fed from the feed path onto the elevator, to a higher position, at which the articles are transferred from the elevator to a wrapping tunnel;

pushing, by a pusher, the orderly group of the articles from the elevator into the wrapping tunnel;

wherein movement of the pusher is controlled as a function of size of the group of the articles to be packaged in a direction of the pushing into the wrapping tunnel; and wherein retracting the pusher into a position of maximum retraction and of carrying out a portion of a forward stroke toward the wrapping tunnel before completion of lifting of the group of the articles to be packaged by the elevator, said portion of the forward stroke being a function of the size of the group of the articles to be packaged.

13. The method of claim 12, wherein the size of the group of the articles is detected by a detection system, or is calculated by a control unit as a function of a format of the articles to be packaged.

14. The method of claim 12, further comprising defining a start position of a forward stroke of the pusher toward the wrapping tunnel, as a function of the size of the group of the articles to be packaged.

15. A packaging machine for packaging articles in packs of plastic film, comprising:

a control unit;

a wrapping tunnel, adapted to form a tube of plastic film around a group of articles;

a feed conveyor, adapted to feed articles to be packaged toward the wrapping tunnel;

an elevator, positioned between the feed conveyor and the wrapping tunnel, and movable vertically from a lower position, to receive articles from the feed conveyor, to a higher position, to transfer articles to the wrapping tunnel;

a pusher to push the articles to be packaged from the elevator into the wrapping tunnel;

wherein the pusher is provided with a reciprocating motion of an insertion stroke to push forward the articles into the wrapping tunnel and of a return stroke to a retracted position with respect to the wrapping tunnel;

wherein the movement of the pusher is controlled as a function of a size of the group of articles to be packaged in a direction of insertion into the wrapping tunnel;

wherein with the elevator, a detection system is adapted to detect the size of the group of articles to be transferred into the wrapping tunnel; and wherein the control unit is functionally connected to the detection system and is adapted to reduce the return stroke of the pusher, with respect to a position of maximum retraction, as a function of the size of the group of articles to be transferred into the wrapping tunnel detected by said detection system.

16. The packaging machine of claim 15, wherein the size of the group of articles is calculated by the control unit as a function of a format of the articles to be packaged.

17. The packaging machine of claim 15, wherein the control unit is interfaced to the detection system of the size of the group of articles, to the pusher and to the elevator.

18. The packaging machine of claim 15, wherein the control unit is configured to coordinate the movement of the pusher and movement of the elevator as a function of the size of the group of articles.

19. The packaging machine of claim 15, further comprising an auxiliary conveyor, positioned between the feed conveyor and the elevator, and an upender, associated with the auxiliary conveyor and adapted to be arranged selectively in an active position, to cooperate with the auxiliary conveyor to upend articles coming from the feed conveyor and transfer the articles upended toward the elevator, and in an idle position.

20. The packaging machine of claim 15, further comprising an auxiliary conveyor positioned between the feed conveyor and the elevator; wherein a movable stop is associated with the auxiliary conveyor, defining a stop position on the auxiliary conveyor of the articles coming from the feed conveyor, the movable stop being adapted to selectively take a withdrawn position, to allow transfer of the articles to be packaged from the auxiliary conveyor to the elevator.

21. The packaging machine of claim 15, wherein the elevator comprises a conveying member adapted to move the articles to be packaged toward the wrapping tunnel.

22. The packaging machine of claim 15, wherein the feed conveyor comprises: a main conveyor belt, with an inlet end and an outlet end for the articles to be packaged; and a continuous flexible member, carrying a plurality of transverse bars, movable along a closed path, with an active portion and a return portion, the active portion extending along a feed path of the main conveyor belt.

23. The packaging machine of claim 15, wherein the control unit is configured to define a loading height of the elevator of the feed conveyor and of an auxiliary conveyor as a function of height of the group of articles.

24. The packaging machine of claim 15, wherein the detection system comprises a plurality of detectors aligned along the direction of feed.

25. The packaging machine of claim 15, wherein the movement of the pusher is controlled as a function of the size detected by the detection system.

26. A method for packaging articles in tubular packs of plastic film, comprising steps of:

feeding a plurality of articles to be packaged along a feed path toward an elevator;

forming on the elevator an orderly group of the articles to be packaged;

lifting by the elevator the orderly group of the articles to be packaged, from a lower position, at which the articles to be packaged are fed from the feed path onto the elevator, to a higher position, at which the articles are transferred from the elevator to a wrapping tunnel;

detecting a size of the orderly group of the articles by a detection system;

defining a start position of a forward stroke of a pusher toward the wrapping tunnel, as a function of the size of the orderly group of the articles to be packaged detected by the detection system;

pushing, by the pusher, the orderly group of the articles from the elevator into the wrapping tunnel.

* * * * *